US006686114B2

(12) United States Patent
Sakon et al.

(10) Patent No.: US 6,686,114 B2
(45) Date of Patent: Feb. 3, 2004

(54) ELECTROPHOTOGRAPHIC IMAGE FORMING METHOD AND APPARATUS

(75) Inventors: Yohta Sakon, Numazu (JP); Hiroshi Nagame, Numazu (JP); Narihito Kojima, Numazu (JP); Hiroshi Ikuno, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/097,848

(22) Filed: Mar. 15, 2002

(65) Prior Publication Data

US 2003/0049555 A1 Mar. 13, 2003

(30) Foreign Application Priority Data

Mar. 15, 2001 (JP) ..... 2001-074470
Feb. 27, 2002 (JP) ..... 2002-052211

(51) Int. Cl.[7] ..... G03G 3/04
(52) U.S. Cl. ..... 430/124; 399/148; 399/159; 399/346
(58) Field of Search ..... 436/124; 399/148, 399/159, 346

(56) References Cited

U.S. PATENT DOCUMENTS 5,204,202 A * 4/1993 Ishikawa et al.
5,871,876 A 2/1999 Ikuno et al.
5,965,243 A * 10/1999 Butler et al. ..... 428/195
6,030,733 A 2/2000 Kami et al.
6,151,468 A 11/2000 Kami et al.
6,163,669 A 12/2000 Aoki et al.

FOREIGN PATENT DOCUMENTS

| | | |
|---|---|---|
| JP | 53-133444 | 11/1978 |
| JP | 55-157748 | 12/1980 |
| JP | 57-030846 | 2/1982 |
| JP | 02-004275 | 1/1990 |
| JP | 04-281461 | 10/1992 |
| JP | 06-130711 | 5/1994 |
| JP | 08-262756 | 10/1996 |
| JP | 09-190125 | 7/1997 |
| JP | 09-288372 | 11/1997 |
| JP | 2000-250245 | 9/2000 |
| JP | 2001-265040 | 9/2001 |

* cited by examiner

*Primary Examiner*—John Goodrow
(74) *Attorney, Agent, or Firm*—Oblon Spivak, McClelland, Maier & Neustadt, P.C.

(57) ABSTRACT

An image forming apparatus including a photoreceptor configured to bear an electrostatic latent image while rotating in a direction, wherein the photoreceptor includes an electroconductive substrate, a photosensitive layer located overlying the substrate, and a protective layer located overlying the photosensitive layer and including a filler; a latent image former configured to form the electrostatic latent image on the photoreceptor; an image developer configured to develop the electrostatic latent image with a developer including a toner; an image transfer device configured to transfer the toner image onto a receiving material; a cleaner configured to remove the toner remaining on the surface of the photoreceptor while contacting the surface of the photoreceptor; and a surface condition controller configured to control a surface condition of the photoreceptor.

23 Claims, 8 Drawing Sheets

ELECTROPHOTOGRAPHIC IMAGE FORMING METHOD AND APPARATUS

BACKGROUND OF THE INVENTION

1. Field of the Invention

The present invention relates to an electrophotographic image forming apparatus using a photoreceptor, and to an electrophotographic image forming method. In addition, the present invention also relates to a process cartridge for use in an electrophotographic image forming apparatus.

2. Discussion of the Background

Electrophotographic image forming methods are widely used for copiers, facsimile machines, laser printers, direct digital printing plate making machines, etc. The electrophotographic image forming methods typically include the following processes:

(1) charging a photoreceptor (charging process);

(2) irradiating the photoreceptor with imagewise light to form an electrostatic latent image thereon (imagewise light irradiation process);

(3) developing the electrostatic latent image with a developer including a toner to form a toner image on the photoreceptor (developing process);

(4) transferring the toner image onto a receiving material such as paper optionally via an intermediate transfer medium (transfer process);

(5) fixing the toner image on the receiving material, for example, upon application of heat and pressure thereto (fixing process); and (6) cleaning the surface of the photoreceptor (cleaning process).

Recently, copiers, facsimile machines and laser printers tend to be personalized. Therefore, such image forming apparatus need to have high durability and stability (i.e., being maintenance-free) and to be small in size.

In addition, such image forming apparatus need to stably produce high quality images because recently the performance of image scanners and personal computers from which images are input to the image forming apparatus has been dramatically improved.

As the electrophotographic photoreceptor (hereinafter referred to as a photoreceptor) for use in such image forming apparatus, inorganic photoreceptors using a material such as selenium or amorphous silicon and organic photoreceptors are known. Among these photoreceptors, organic photoreceptors have been typically used because of having low costs, good designing flexibility and being non-polluting.

Specific examples of the organic photoreceptors include photoreceptors having the following photosensitive layers:

(1) photosensitive layers including a photoconductive resin typified by polyvinylcarbazole (PVK);

(2) photosensitive layers including a charge transfer complex typified by polyvinylcarbazole-2,4,7-trinitrofluorenon (PVK-TNF);

(3) photosensitive layers including a pigment dispersion typified by a phthalocyanine-binder system; and (4) functionally-separated photosensitive layers using a combination of a charge generation material and a charge transport material.

Among these photoreceptors, the functionally-separated photoreceptors attract attention.

The mechanism of forming an electrostatic latent image on a functionally-separated photoreceptor is as follows:

(1) when imagewise light irradiates a charged photoreceptor, the imagewise light is absorbed by a charge generation material in a charge generation layer after passing through a transparent charge transport layer located overlying the charge generation layer;

(2) the charge generation material absorbing light generates a charge carrier;

(3) the charge carrier is injected into the charge transport layer and transported through the charge transport layer (or the photosensitive layer) along an electric field generated by the charge formed on the surface of the photoreceptor; and (4) the charge carrier neutralizes the charge on the surface of the photoreceptor, resulting in formation of an electrostatic latent image.

In the functionally-separated photoreceptors, a combination of a charge transport material having an absorption in an ultraviolet region and a charge generation material having an absorption in a visible region is known. In addition, recently laser diodes emitting light having a relatively short wavelength have been developed and used, and therefore various constructions have been investigated for the functionally-separated photoreceptors.

Various organic photoreceptors have been developed. However, in order that the photoreceptors are practically used, the photoreceptors need to have good electrophotographic properties such as high sensitivity, high potential, high potential retainability, good potential stability, low residual potential and proper spectral properties; good mechanical durability such as high abrasion resistance; good chemical stability against heat, light and discharge-induced products (e.g. ozone and NOx), etc.

In particular, a need exists for a photoreceptor having a small diameter because downsizing of electrophotographic systems is strongly desired. Therefore, a need exists for a photoreceptor having good resistance to abrasion which increases in proportion to the number of produced copies.

Thus, mechanical durability which typically means abrasion resistance is strongly needed. However, conventional organic photoreceptors and electrophotographic apparatus using the photoreceptors do not have high durability because the organic materials used have low abrasion resistance. In addition, the need for a photoreceptor having good abrasion resistance has increased because the thickness of a photosensitive layer has to be decreased to produce high definition images. Thus the designing flexibility of the photosensitive layers becomes smaller and smaller.

The reason why the thickness of a photosensitive layer has a particularly big influence on producing high definition images is considered as follows.

Among positive and negative carriers formed in the charge generation layer of a negatively chargeable multilayer organic photoreceptor by light irradiation, the negative carrier (i.e., an electron) is absorbed in the substrate and the positive carrier (i.e., a hole) is transported through the charge transport layer to the surface of the photoreceptor to be re-combined with the electron thereat, resulting in pair-disappearance of the hole and electron.

Due to this pair-disappearance, the electric field moving the hole toward the surface of the photoreceptor gradually decreases, and the hole moves toward a non-lighted area.

This is called a carrier scattering phenomenon in a direction of the surface of the photoreceptor, and because of the carrier scatter phenomenon, formation of a latent image faithful to the irradiated light is prevented. This results in formation of a poor image having low resolution.

The thickness of the charge transport layer has a big influence on the carrier scattering phenomenon, and making the thickness smaller is very effective for producing high resolution images.

In addition, laser irradiation, which is typically used recently, is different from irradiation using a halogen lamp, etc. because the incident photon speed of a laser is about $10^7$ times that of a halogen lamp. Therefore, the density of the formed carriers is extremely high, and the electric field strength of the charge generation layer decreases because charges flow into the charge transport layer. Thereby, the carrier transport speed is decreased, resulting in late arrival of the carrier, which is formed by irradiation of the center portion of the laser beam, at the surface of the photoreceptor. The thus formed space charge distribution tends to cause carrier scattering in a direction parallel to the surface of the photoreceptor, resulting in deterioration of the image resolution.

In attempting to improve the abrasion resistance of an organic photoreceptor, Japanese Laid-Open Patent Publication No. (hereinafter referred to as JOP) 57-30846 discloses a photoreceptor in which a protective layer including a filler such as a metal or a metal oxide is formed on the surface of the photoreceptor. The object of this method is to increase the transparency of the protective layer to prevent increase of residual potential by using a filler having an average particle diameter not greater than 0.3 $\mu$m. In addition, JOP 4-281461 discloses a photoreceptor, in which a charge transport material is included in a protective layer together with a filler to prevent increase of residual potential while maintaining good abrasion resistance. JOPs 53-133444 and 55-157748 have disclosed a photoreceptor, in which an organic acid is included in a protective layer together with a filler. JOP 2-4275 discloses a photoreceptor, in which an electron accepting material is included in a protective layer to prevent increase of residual potential.

The abrasion resistance may be improved by these techniques. However, the following problems tend to occur:

(1) a toner film is formed on the carrier used and/or the surface of the photoreceptor used and various members such as developing sleeves and cleaning blades; and/or (2) the cleaning blade used is unevenly abraded due to asperities of the surface of the photoreceptor caused by the filler included in the photoreceptor, resulting in insufficient cleaning of the photoreceptor, and thereby background fouling is formed.

Thus, photoreceptors having good abrasion resistance while producing good images have not yet been developed.

JOPs 6-130711 and 2000-250245 have disclosed a photoreceptor which includes a fluorine-containing particulate resin and which has a specified surface roughness. In addition, the hardness and friction coefficient of the surface of the photoreceptor are specified therein. It is described therein that the photoreceptor has good cleaning property.

JOPs 8-262756, 9-190125, 9-288372 and 2001-265040 have disclosed photoreceptors in which an inorganic filler is included in an outermost layer and which have a specific surface roughness. In addition, these background art has disclosed the following techniques:

(1) a release agent is included in the toner:

(2) a cleaning blade is vibrated; and (3) a fatty acid is supplied to the surface of the photoreceptor used.

However, according to the present inventors' investigation, the characteristics of these photoreceptors deteriorate when the photoreceptors are used for a long period of time and/or environmental conditions are changed. Specifically, when the photoreceptors are run to produce not less than 200,000 copies, the photoreceptors become unstable, namely the durability of the photoreceptors is not satisfactory. It is found that maintenance of the surface condition of the protective layer is very important for forming high quality images.

Because of these reasons, a need exists for an electrophotographic image forming method and apparatus by which high quality images can be stably produced for a long period of time.

SUMMARY OF THE INVENTION

Accordingly, an object of the present invention is to provide an electrophotographic image forming apparatus which is more durable and stable than conventional electrophotographic image forming apparatus and which can produce images at a high speed.

Another object of the present invention is to provide a durable digital electrophotographic image forming apparatus in which high resolution images are written using a laser beam without causing undesired images such as tailing.

Yet another object of the present invention is to provide a process cartridge for use in an electrophotographic image forming apparatus, which is more durable and stable than conventional process cartridges.

A further object of the present invention is to provide an electrophotographic image forming method by which high quality images can be stably produced for a long period of time.

Briefly these objects and other objects of the present invention as hereinafter will become more readily apparent can be attained by an image forming apparatus including a photoreceptor serving as an image bearer which rotates in a direction and which includes an electroconductive substrate, a photosensitive layer located overlying the substrate, and a protective layer located overlying the photosensitive layer and including a filler; a latent image former configured to form an electrostatic latent image on a surface of the photoreceptor; an image developer configured to develop the electrostatic latent image with a developer including a toner to form a toner image on the surface of the photoreceptor; an image transfer device configured to transfer the toner image onto a receiving material optionally via an intermediate transfer medium; a cleaner configured to remove the toner remaining on the surface of the photoreceptor while contacting the surface of the image bearer; and a surface condition controller configured to control a surface condition of the photoreceptor.

The surface condition controller controls the surface condition of the photoreceptor such that the surface of the photoreceptor maintains a maximum height not greater than 3 $\mu$m in a part of a profile of the surface of the photoreceptor, in a sampling range of 50 $\mu$m in a direction perpendicular to the rotating direction of the photoreceptor.

The surface condition controller preferably includes a lubricant applicator configured to apply a lubricant to the surface of the photoreceptor. The lubricant applicator is preferably located at a position after the cleaner and before the image developer relative to the rotating direction of the photoreceptor.

The lubricant may be applied to the photoreceptor by a charger of the latent image former, a transfer belt of the image transfer device or a cleaning brush of the cleaner.

Alternatively, the lubricant may be applied to the surface of the photoreceptor by the toner which includes the lubricant. The toner may include a lubricant powder and toner particles. Alternatively the toner may include a wax as a lubricant.

The friction coefficient of the surface of the photoreceptor against paper is from 0.3 to 0.5 when measured based on an Euler belt method.

The latent image former preferably has a charger which charges the photoreceptor while contacting the surface of the photoreceptor (i.e., contact charging) or forming a narrow gap between the surface of the photoreceptor and the charger (i.e., proximity charging).

The charger preferably applies a DC voltage overlapped with an AC voltage to the photoreceptor.

Another aspect of the present invention, a process cartridge is provided which includes a photoreceptor and at least one of the latent image former, image developer, transfer device and cleaner mentioned above, wherein the surface of the photoreceptor maintains a maximum height not greater than 3 $\mu$m in a part of a profile of the surface of the photoreceptor, in a sampling range of 50 $\mu$m in a direction perpendicular to the rotating direction of the photoreceptor, and/or the surface of the photoreceptor has a friction coefficient of from 0.3 to 0.5.

Yet another aspect of the present invention, an image forming method is provided which includes forming an electrostatic latent image on the photoreceptor mentioned above; developing the latent image with a developer including a toner to form a toner image on the photoreceptor; transferring the toner image onto a receiving material; and controlling the surface roughness of the photoreceptor such that the maximum height of the surface of the photoreceptor is not greater than 3 $\mu$m in a part of a profile of the surface of the photoreceptor, in a sampling range of 50 $\mu$m in a direction perpendicular to the rotating direction of the photoreceptor, and/or the surface of the photoreceptor has a friction coefficient of from 0.3 to 0.5.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

It is clear that a photoreceptor having good abrasion resistance is needed to provide a highly durable image forming apparatus. However, an image forming apparatus having a photoreceptor having good abrasion resistance is not necessarily highly durable. Specifically, the surface conditions (such as surface roughness) of the photoreceptor used are preferably controlled such that materials adhered on the surface are easily removed to keep the surface clean. The main object of the present invention is to provide an image forming apparatus having a photoreceptor whose surface conditions (such as surface roughness) are properly controlled. The another object of the present invention is to provide a method for cleaning the materials adhered to the surface of the photoreceptor.

As a result of the present inventors' investigation, the following is found:

(1) by supplying a lubricant on the surface of a photoreceptor having a protective layer (i.e., the outermost layer) including a filler, the toner filming problem in that a toner film is formed on the surface of the photoreceptor used can be prevented, and in addition the surface conditions of the photoreceptor can be controlled such that the surface is properly abraded little by little;

(2) by performing the lubricant application mentioned in item (1), the tailing problem in that resultant toner images have a tail can also be prevented while the surface conditions of the photoreceptor are controlled;

(3) by performing contact charging or proximity charging using a DC voltage overlapped with an AC voltage, the charger is minimized in size and in addition the life of the charger can be prolonged while the photoreceptor is uniformly charged, and thereby high quality images can be produced for a long period of time.

Thus, the present invention is made. The charger for use in the image forming apparatus of the present invention has a big influence on the deterioration of photoreceptors. The charger can only be used in combination with the photoreceptor, and other image forming members used in the image forming apparatus of the present invention.

The image forming apparatus of the present invention will be explained in detail referring to drawings.

Figure 1:
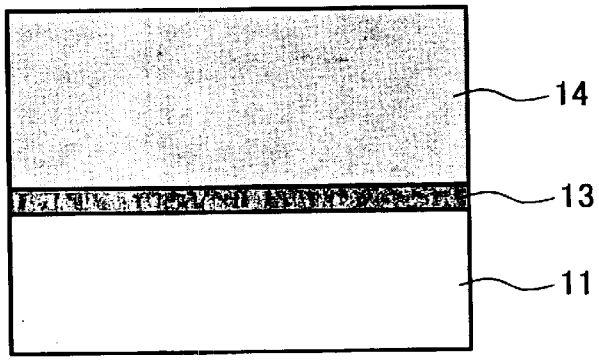
FIG. 1 is a schematic view illustrating an embodiment of the image forming apparatus of the present invention.

FIG. 1 is a schematic view illustrating an embodiment of the main part of the image forming apparatus of the present invention.

In FIG. 1, numeral 101 denotes a photoreceptor (drum) which rotates in a direction indicated by an arrow. Around the photoreceptor 1, a charger 102, an image developer 104, a contact image transfer device 106, a cleaning blade 107, a discharging lamp 108 and a fixer 109 are provided. In addition, imagewise light 103, which is emitted from an imagewise light irradiator (not shown), irradiate the surface of the photoreceptor 101. A receiving material 105 is fed to the nip between the contact image transfer device 106 and the photoreceptor 101.

These members can be set in the image forming apparatus while incorporated in a process cartridge. Specifically, a process cartridge having a photoreceptor and at least one of a charger, an imagewise light irradiator, an image developer, an image transfer device, a cleaner and a discharger may be set in the image forming apparatus.

Figure 2:
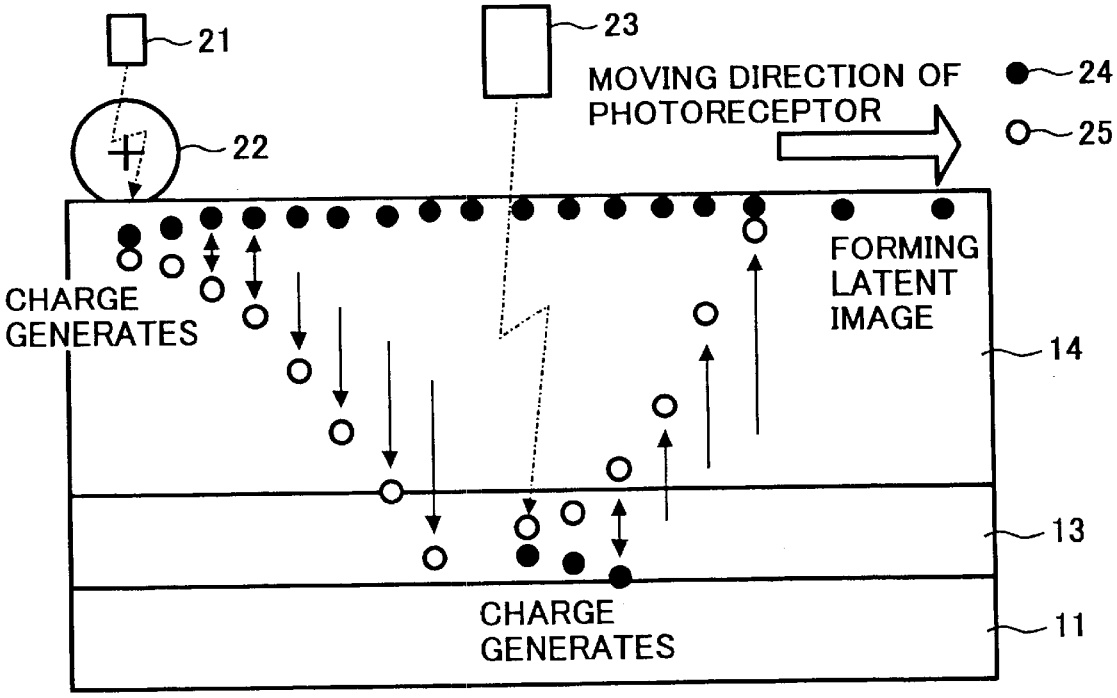
FIGS. 2 and 3 are schematic views illustrating an embodiment of the lubricant applicator for use in the image forming apparatus of the present invention.
Figure 3:
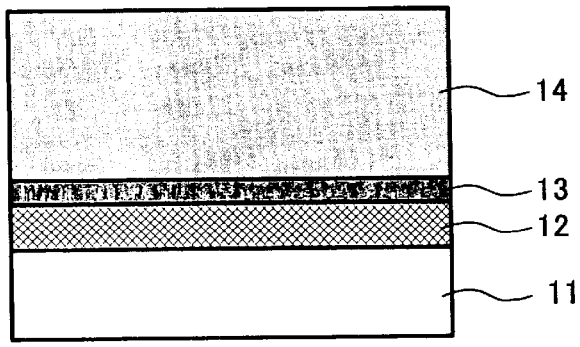

FIGS. 2 and 3 are schematic views illustrating an embodiment of the lubricant applicator for use in the image forming apparatus of the present invention.

Figure 4:
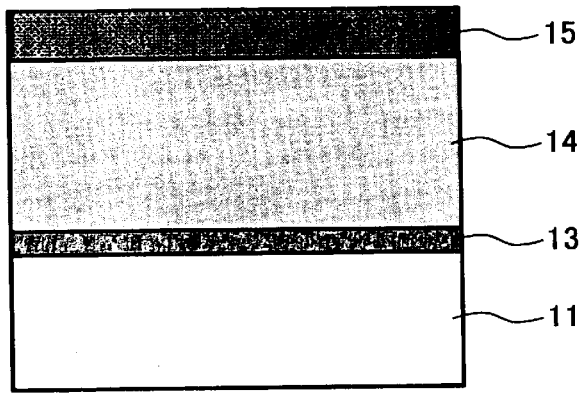
FIGS. 4 and 5 are schematic views illustrating another embodiment of the lubricant applicator for use in the image forming apparatus of the present invention.
Figure 5:
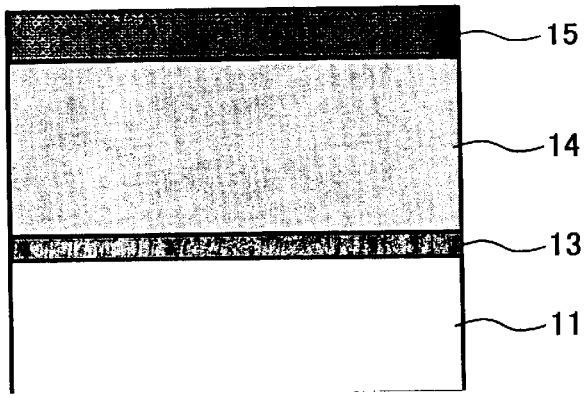

FIGS. 4 and 5 are schematic views illustrating another embodiment of the lubricant applicator for use in the image forming apparatus of the present invention.

Figure 6:
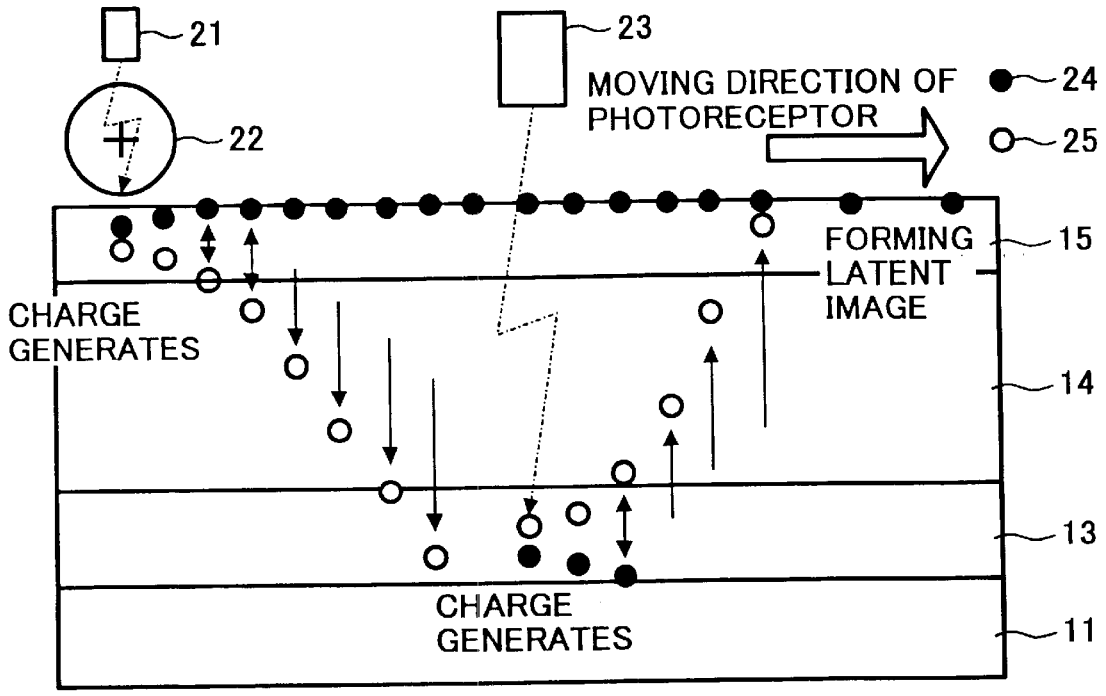
FIGS. 6 and 7 are schematic views illustrating other embodiments of the lubricant applicator for use in the image forming apparatus of the present invention.

FIG. 6 is a schematic view illustrating yet another embodiment of the lubricant applicator.

Figure 7:
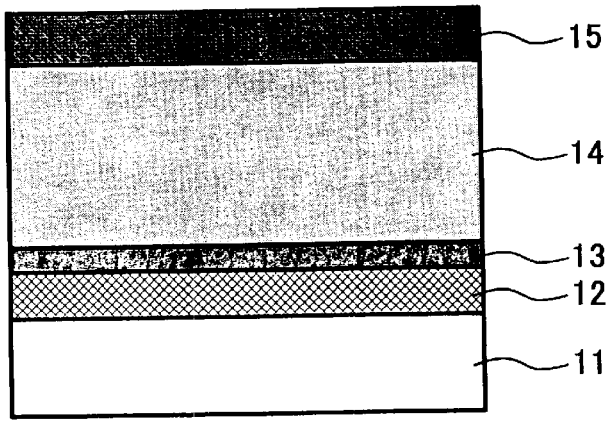

FIG. 7 is a schematic view illustrating a further embodiment of the lubricant applicator.

These lubricant applicators will be explained in detail below. The lubricant applicator for use in the present invention is not limited thereto, and any lubricant applicator which externally applies a lubricant to the surface of the photoreceptor 101 can be used.

The image forming processes of the image forming apparatus of the present invention will be explained in detail.

In the charging process, which is the first step of the electrophotographic image forming processes, chargers utilizing discharging, such as corotrons and scorotrons have been conventionally used. Recently, chargers using a charging roller are typically used because the size of chargers can be minimized and the amount of ozone which is generated due to discharging can be reduced.

In the chargers using a roller, the roller may contact the surface of the photoreceptor or may be arranged closely to the photoreceptor while a gap of from 10 $\mu$m to 200 $\mu$m is formed between the surface of the photoreceptor and the surface of the roller. When the latter charger (i.e., a proximity charger) is used, the abrasion of the roller and the photoreceptor can be reduced and in addition the toner filming problem can be avoided. In the image forming apparatus of the present invention, the proximity charger is preferably used and the gap is preferably about 50 $\mu$m to maintain the good conditions of the surface of the photoreceptor (i.e., to minimize influence of the charger on the surface conditions of the photoreceptor).

In order to uniformly charge the photoreceptor, a DC voltage overlapped with an AC voltage is preferably applied to the surface of the photoreceptor. However, when such a DC voltage overlapped with an AC voltage is applied to a photoreceptor, the photoreceptor tends to be relatively abraded compared to the case in which only a DC voltage is applied. However, the photoreceptor of the present invention has good abrasion resistance, and therefore the abrasion problem does not occur.

Specific examples of the contact chargers for use in the present invention include brush chargers, roller-form brush chargers, roller chargers, blade chargers, belt chargers, etc., which have a proper electroconductivity and an elasticity. The contact chargers have an advantage over non-contact chargers such that the voltage applied to the photoreceptor can be minimized, and thereby the amount of ozone which is generated by discharging and which chemically damages human beings and photoreceptors can be reduced.

After the charging process, the imagewise light irradiating process is performed. In the imagewise light irradiating process, an analogue light image which is a light image reflected from an original document which light irradiates, a digital light image which is obtained by converting the electric signals sent from a computer or reproducing an original image read by CCD or the like, using laser light or LED light, can be used. Recently digital light images are typically used because various image processings can be easily performed and in addition good images can be stably written on the surface of photoreceptors.

Recently, needs for high quality images increases more and more. Therefore the diameter of light beams emitted by laser diodes and LEDs is decreased year by year. Recently, the optics to focus light beams have been improved, and thereby the beam diameter is reduced to a diameter not greater than 50 $\mu$m. At this point, the beam diameter is defined as follows. Provided that the light quantity of the peak (i.e., the center) of a light spot is P, the diameter of a circle formed by connecting points having a light quantity of $P/e^2$ in the light spot is defined as the beam diameter.

After the imagewise light irradiating process, a developing process in which the electrostatic latent image formed on the photoreceptor is developed with a developer is performed. Specific examples of the image developer for use in the present invention include image developers containing a one component developer, a two component developer, a liquid developer or the like developers. Thus, a toner image is formed on the surface of the photoreceptor.

The thus formed toner image is transferred by an image transfer device on a receiving material such as papers and plastic films optionally via an intermediate transfer medium. As the image transfer device, non-contact image transfer devices using corona discharging and contact image transfer devices using a roller, brush, belt or the like members can be used.

After the toner image is transferred, the surface of the photoreceptor is cleaned with a cleaner to remove the toner remaining thereon. Cleaners using a roller-form brush or an elastic blade are typically used.

In the image forming apparatus of the present invention, any known chargers, imagewise light irradiators, image developers, image transfer devices and cleaners can be used. The image forming apparatus of the present invention has a photoreceptor having good abrasion resistance because of having a protective layer including a filler. In order to effectively use such a photoreceptor having good abrasion resistance, a lubricant is applied to the surface of the photoreceptor to maintain the surface conditions of the photoreceptor.

In order to stably produce high definition images, it is necessary not to change the surface conditions of the photoreceptor used as much as possible. It is confirmed by the present inventors that when a protective layer including a filler is formed on the surface of a photoreceptor, the surface conditions of the surface of the protective layer tends to change in repeated use. Namely, ridges and grooves on the order of a few micrometers are formed on the surface of the photoreceptor in the rotating direction of the photoreceptor. The reason for formation of the ridges and grooves is considered as follows.

At the surface of the photoreceptor including a filler, projected portions (i.e., projected fillers) mainly contact the cleaning blade and resist the blade such that the surface of the protective layer is not abraded. This is also true for the cases in which a cleaning brush is used. When surface portions which do not include a filler or include a filler in a small amount are rubbed with the cleaning blade, the surface portions tend to be abraded, for example, by the toner particles, additives included in the toner or the like materials. Thus, ridges and grooves are formed in the rotating direction of the photoreceptor.

Since ridges and grooves are formed in lines in the rotating direction of the photoreceptor, it is clear that the ridges are formed of only remaining fillers because the fillers are not arranged in lines. As a result of the present inventors' investigation, toner and paper are detected as the constituents of the ridges. Namely, films are formed in lines on the surface of the photoreceptor. The reason for formation of the ridges and grooves is considered as follows. When a cleaning blade scrapes the surface of a photoreceptor while contacting a projected filler portion, a ridge is formed on the surface of the photoreceptor while the projected filler portion is a starting point of the ridge. On the ridge, a film is formed because the ridge hardly abrades. In contrast, when the blade contacts abradable portions of the surface, the portions are easily abraded by the blade, resulting in formation of grooves. Thus, ridges and grooves are formed at the same time.

Figure 9:
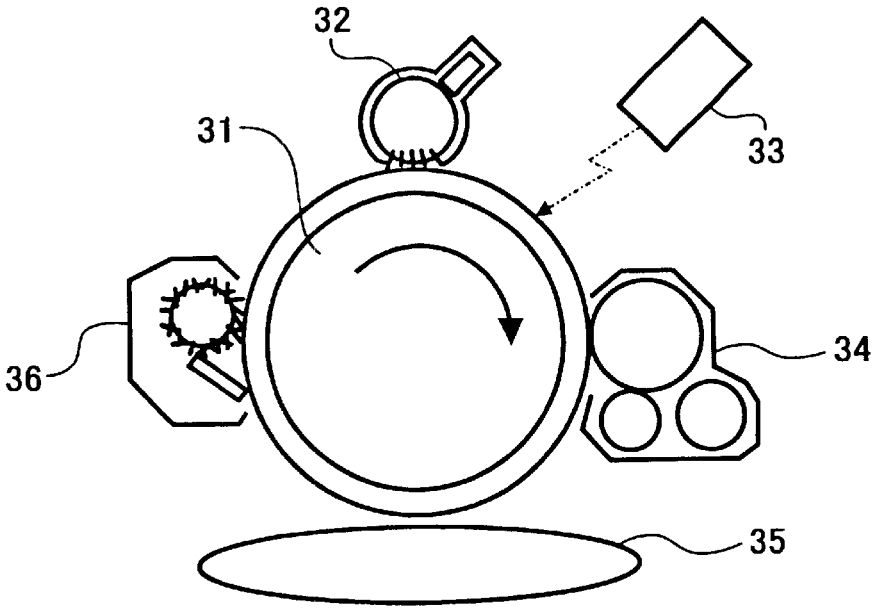
FIG. 9 is a schematic view for explaining how to determine the maximum height of the surface of a photoreceptor.

When such ridges and grooves are formed in the rotating direction of the photoreceptor, the cleanability of the photoreceptor deteriorates. The purpose of the cleaning process is to remove toner particles remaining on the surface of the photoreceptor. However, when such ridges and grooves are formed on the surface of the photoreceptor, the photoreceptor is insufficiently cleaned because contact of the blade with the surface of the photoreceptor deteriorates. As a result of the present inventors' investigation, it is found that when the maximum height H of any profile of the surface of the photoreceptor, which is shown in FIG. 9, is not greater than 3 $\mu$m in a range of 50 $\mu$m, the cleaning problem hardly occurs.

As mentioned above, it is important in the present invention that the maximum height H of any profile of the surface of the photoreceptor is maintained so as to be not greater than 3 $\mu$m in a range of 50 $\mu$m during the usage period of the photoreceptor (i.e., until the expiration date of the photoreceptor). The life of a photoreceptor is predetermined for each image forming apparatus based on the number of copying sheets, the period described in the specification of the image forming apparatus or the like.

The reason why the maximum height should be not greater than 3 $\mu$m is considered to be that the particle diameter of the toner used is about 6 $\mu$m, and therefore toner particles cannot pass through such gaps not greater than 3 $\mu$m. In addition, the reason why the maximum height should be measured in a range of 50 $\mu$m is considered to be that the particle diameter of the carrier typically used is from 50 to 80 $\mu$m and therefore the toner is adhered to the surface of a photoreceptor in lines at an interval of about 50 to 80 $\mu$m. The maximum height can be measured by a surface analyzer such as VK-8550 COLOR LASER 3D PROFILE MICROSCOPE manufactured by KEYENCE CORPORATION.

The above-mentioned phenomenon (i.e., formation of ridges and grooves) is specific for photoreceptors having a protective layer including a filler. In order to stably produce high resolution images for a long period of time, the phenomenon should be taken into consideration.

As mentioned above, a film tends to be formed on the ridges. In this case, the film tends to include discharge products and paper dust, and thereby the tailing problem occurs and/or resolution of images and evenness of solid images tend to deteriorate.

Including a filler in a protective layer imparts good abrasion resistance to the resultant photoreceptor. However, as mentioned above, it is necessary that a photoreceptor should have good abrasion resistance and in addition the good surface conditions of the photoreceptor have to be maintained to stably produce high quality images for a long period of time.

It is discovered that when the surface conditions of the photoreceptor of the present invention are maintained such that the maximum height of a part of a profile of the surface is not greater than 3 $\mu$m in a sampling range of 50 $\mu$m in the direction perpendicular to the rotating direction of the photoreceptor, high quality images can be stably produced. In addition, it is discovered that by applying a lubricant to the surface of the photoreceptor, the surface conditions can be maintained.

Until now, a lubricant is applied to the surface of a photoreceptor to decrease the friction coefficient of the surface of the photoreceptor, namely to improve the abrasion resistance thereof. Therefore the suitable friction coefficient of the surface of a photoreceptor is from 0.1 to 0.3. However, in the present invention, by controlling the suitable friction coefficient of the surface of the photoreceptor so as to be from 0.3 to 0.5, the formation of ridges and grooves on the surface of the photoreceptor in the rotating direction can be controlled such that the maximum height of the surface having the ridges and grooves is not greater than 3 $\mu$m.

In order to controlled the friction coefficient so as to be from 0.3 to 0.5, a small amount of a lubricant should be applied to the surface of the photoreceptor. In this case, a lubricant is applied to improve the releasing properties of the surface of the photoreceptor rather than to decrease the friction coefficient of the surface thereof. Specifically, a small amount of a lubricant is adhered to the surface of the photoreceptor and cleaning blade and/or cleaning brush, and thereby the filming problem can be prevented. Namely, since the friction coefficient of the surface is controlled so as not to be too low, films formed on the surface or the lubricant applied thereto are appropriately removed, i.e., proper releasing and abrasion effects can be exerted.

As mentioned above, the photoreceptor of the present invention has a protective layer including a filler to improve the abrasion resistance thereof. Therefore the surface of the photoreceptor has projected portions under which filler particles are present, and projected portions at the surface of which one or more filler particles are exposed to the air. The abrasion of the photoreceptor can be decreased due to the projections. In other words, the portions of the cleaning blade contacting the projected portions are damaged. Therefore the cleaning ability of the cleaning blade slightly deteriorates until the damaged (deformed) portions of the blade are restored. The particle diameter of the filler included in the protective layer is about 0.5 $\mu$m. If the cleaning blade is damaged on the order of the particle diameter (i.e., about 0.5 $\mu$m), the external additive such as silica included in the toner can easily pass through the damaged portions. When the rotating speed of the photoreceptor is high (i.e., when high speed reproduction is performed), the cleaning blade has to be rapidly restored. In addition, there is a possibility that the cleaning blade is broken by the projected portion.

Under such circumstances, by controlling the friction coefficient of the photoreceptor so as to be from 0.3 to 0.5, the abrasion of the protective layer and filming can be repressed while preventing the influence of the projections on the cleaning blade. Thus, by controlling the friction coefficient of the surface of the photoreceptor, the maximum height of the surface of the photoreceptor can be controlled so as to be 3 $\mu$m in a sampling range of 50 $\mu$m in the rotating direction of the photoreceptor, and thereby high quality images can be stably produced for a long period of time.

In the present invention, the friction coefficient of the surface of the photoreceptor was measured by an Euler belt method. The Euler belt method will be explained.

Figure 10:
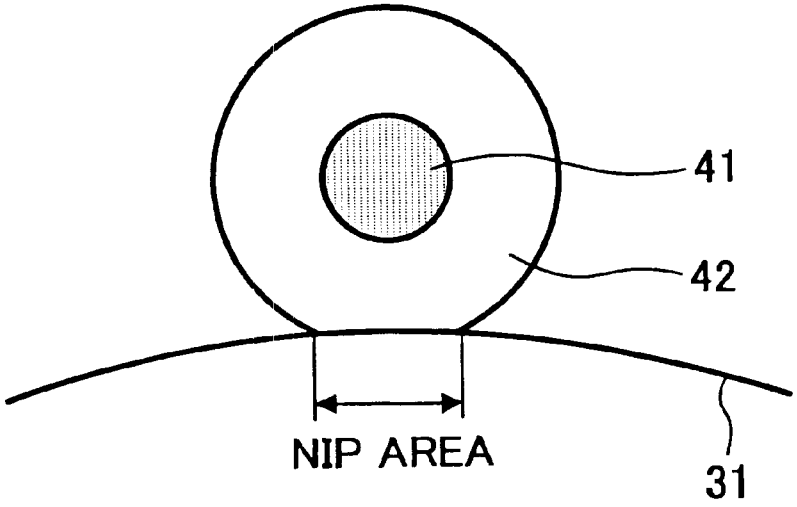
FIG. 10 is a schematic view illustrating an embodiment of the instrument of measuring friction coefficient of the surface of a photoreceptor using an Euler belt method.
Figure 11:
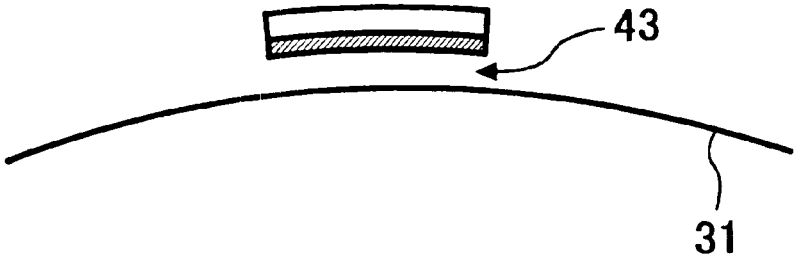
Figure 12:
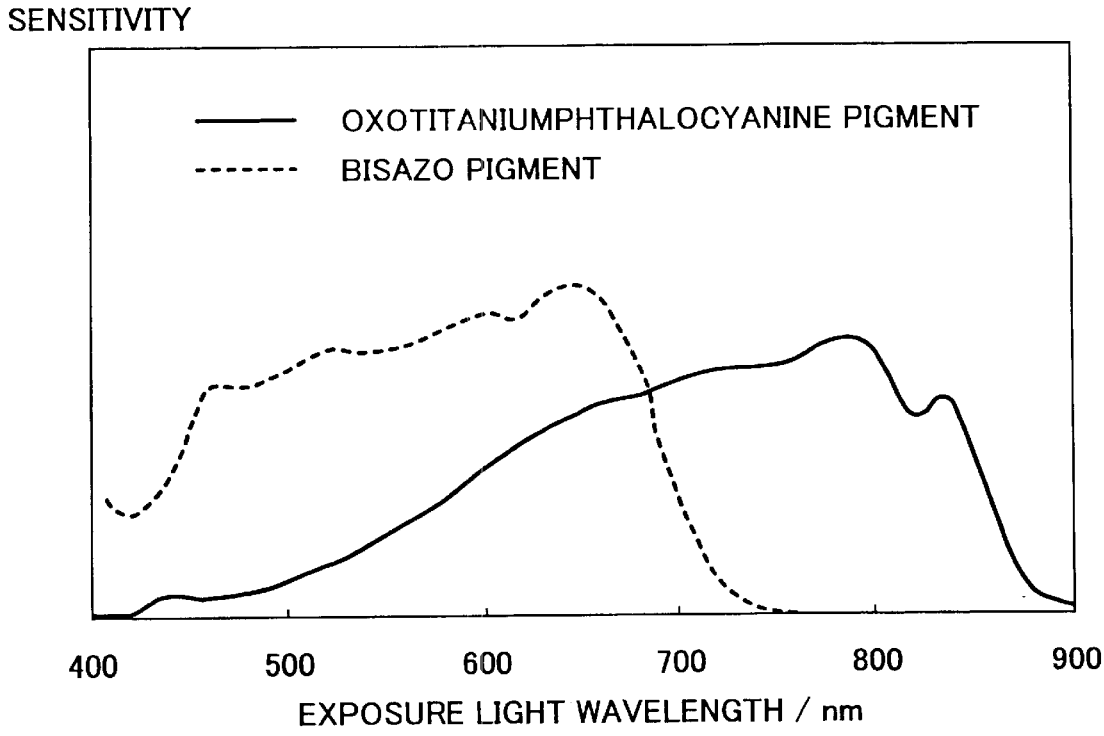
Figure 13:
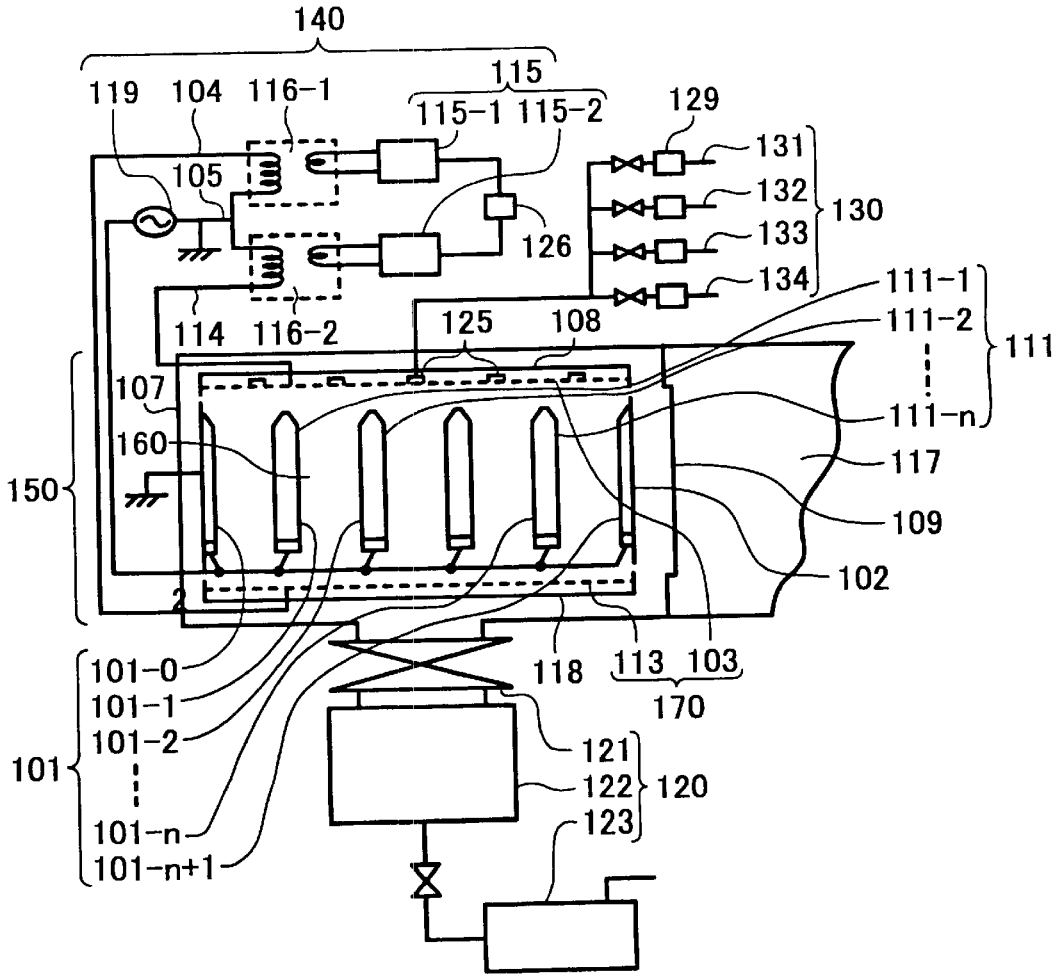
Figure 14:
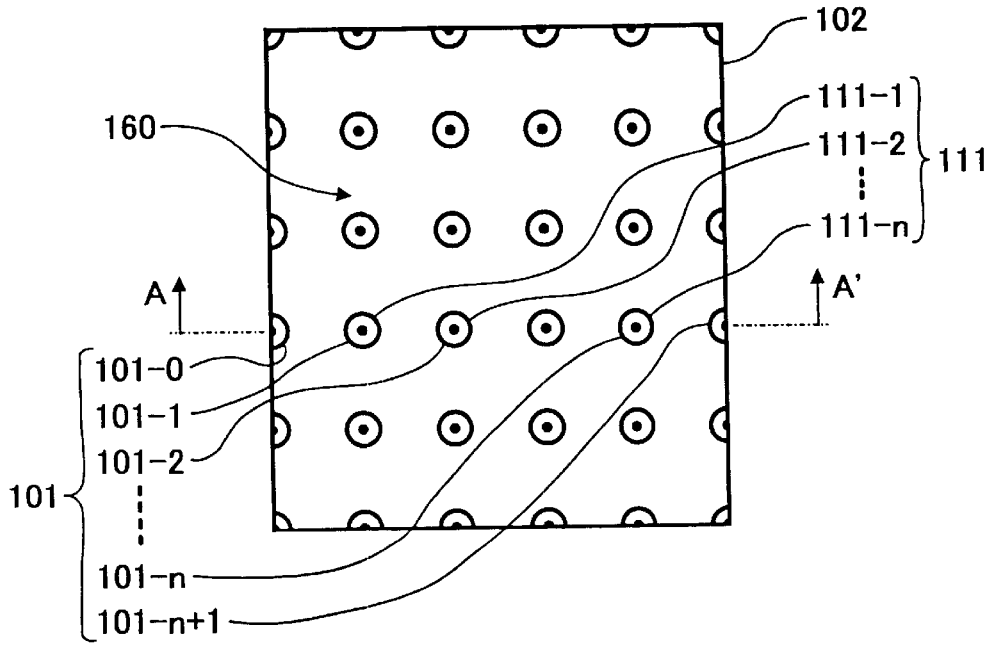
Figure 15:
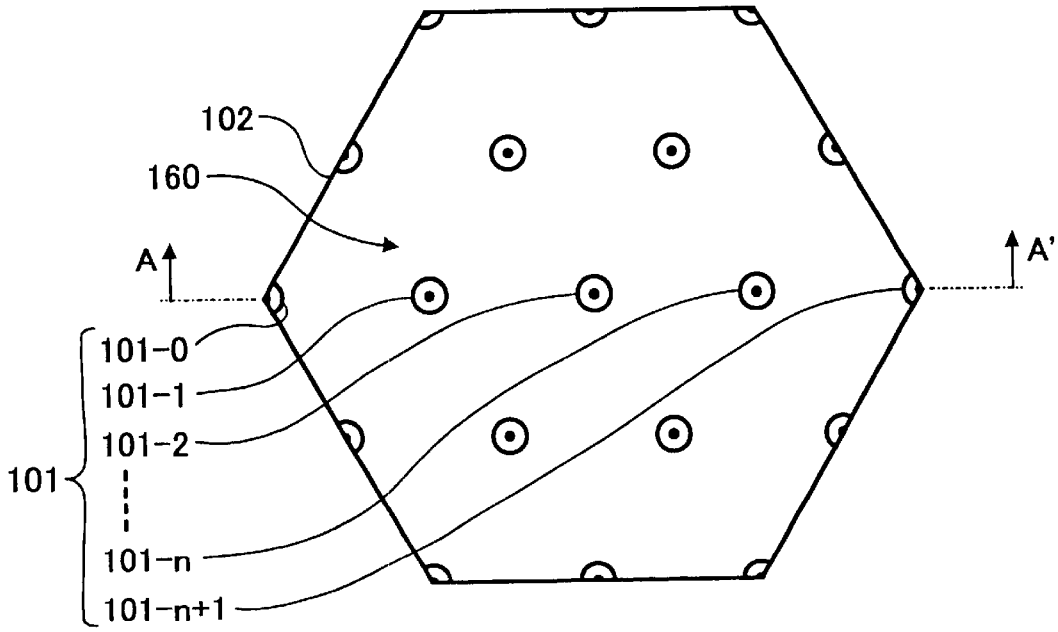
Figure 1:
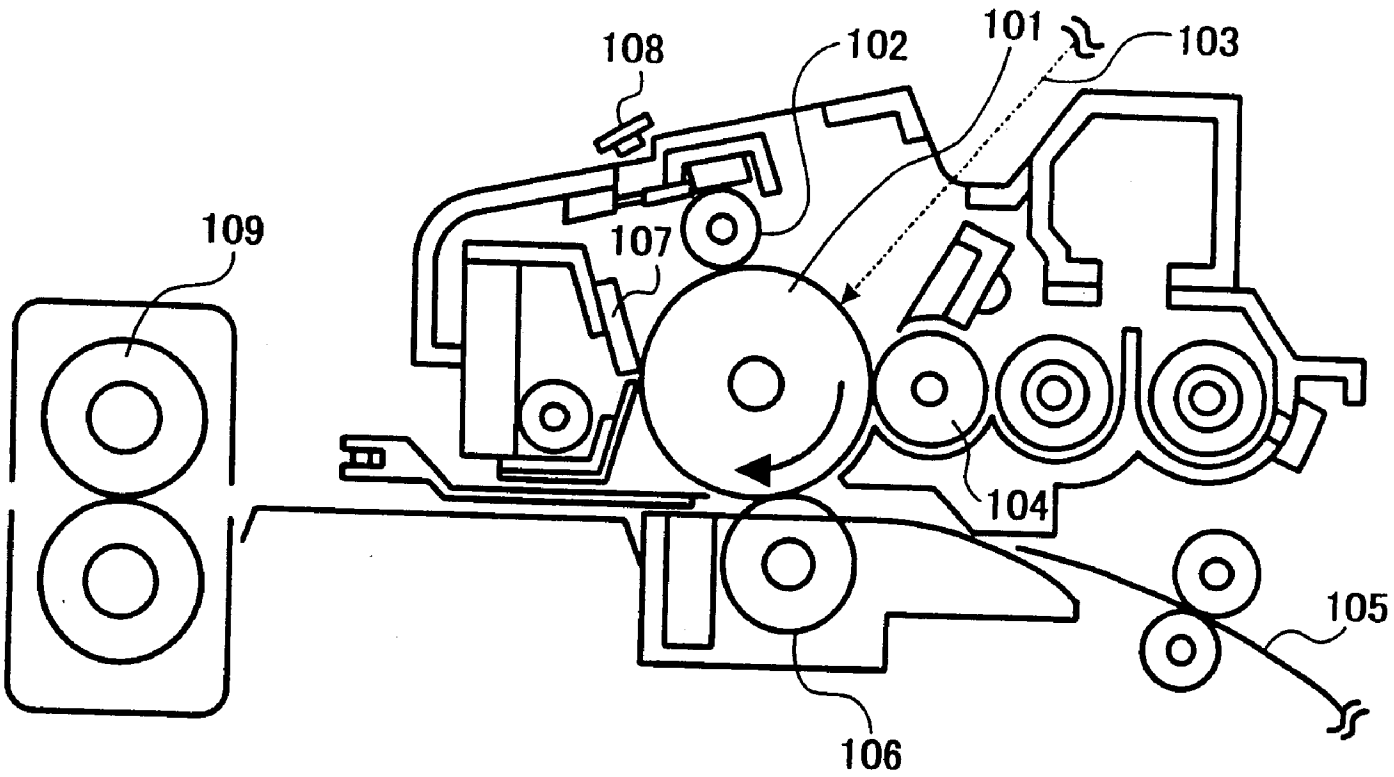
Figure 2:
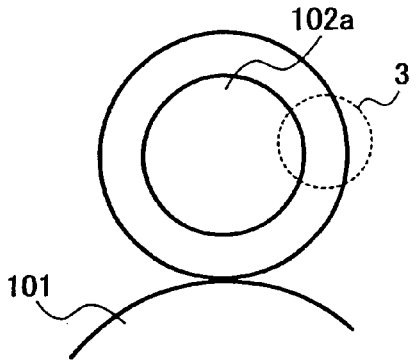
Figure 3:
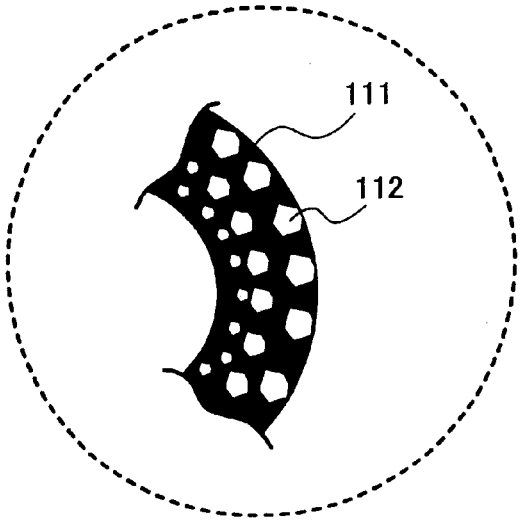
Figure 4:
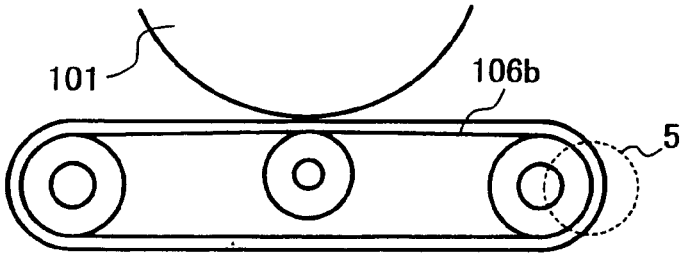
Figure 5:
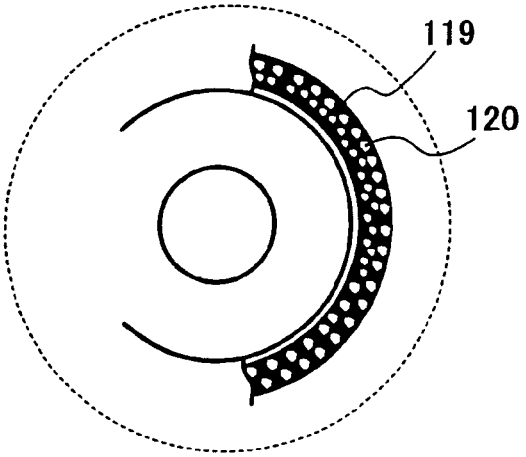
Figure 6:
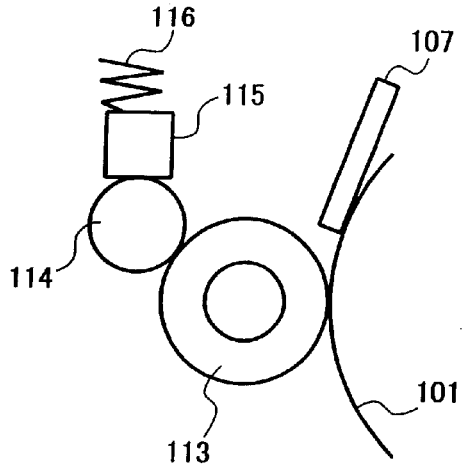
Figure 7:
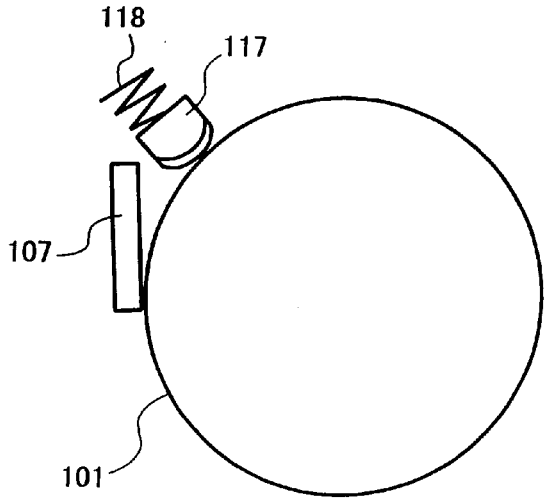
Figure 8:
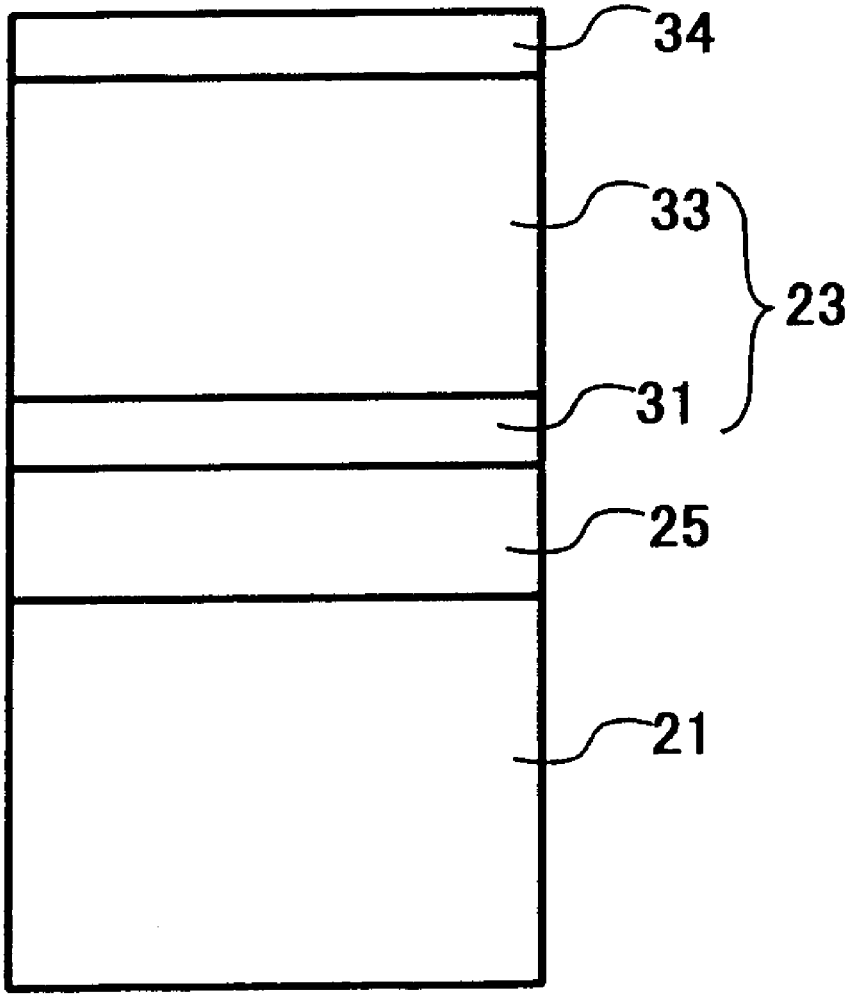
Figure 9:
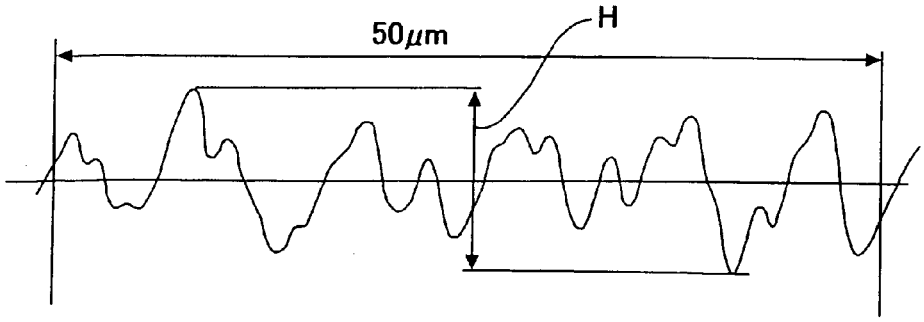
Figure 10:
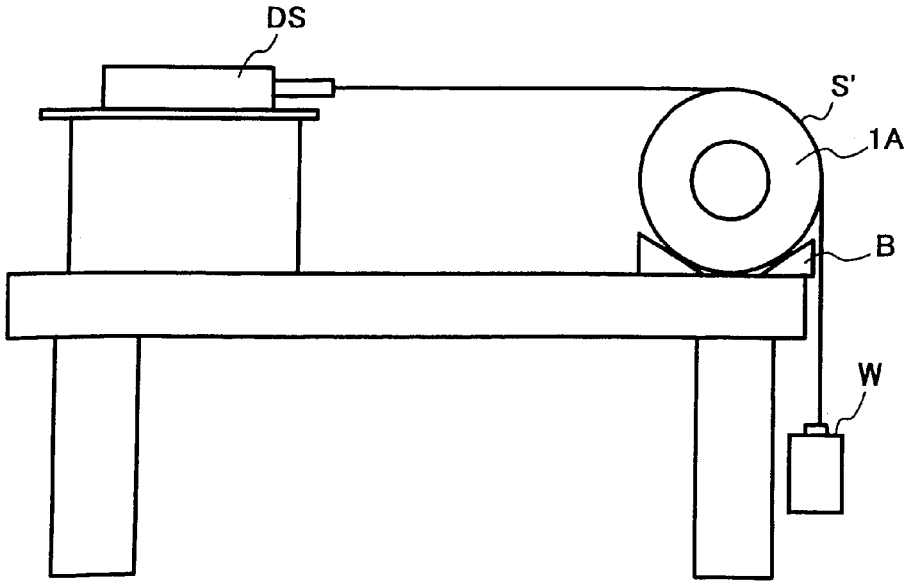

The measuring instrument for use in the Euler belt method is shown in FIG. 10.

A character S' denotes a paper to be measured which have a middle thickness. Two hooks are set at each end of the paper S', and a load w (100 g) is set at one hook and a digital force gauge DS is set at the other hook. The paper S' is set in the measuring instrument so as to contact a photoreceptor 1A which is held by a block B, as shown in FIG. 10. The paper S' contacts one fourth of the peripheral surface of the photoreceptor. The paper S' is pulled slowly with the digital force gauge DS. Provided when a force at which the paper S' starts to move is F, the coefficient of static friction of the photoreceptor 1A is determined by the following equation:

$$\mu s=(\pi/2)\ln(F/w)$$

wherein $\mu s$ is the coefficient of static friction of the photoreceptor 1A, F is the measured value of the force, and w is the load (gram-force).

In the image forming apparatus of the present invention, the method for applying a lubricant to the surface of the photoreceptor includes, for example, the following methods:

(1) a lubricant is directly contacted with the surface of the photoreceptor (direct application method);

(2) a lubricant is applied to the surface of the photoreceptor via an intermediate transfer member such as rollers, brushes and belts (indirect application method); and (3) a lubricant is included in the toner used.

The lubricant application methods as shown in FIGS. 2, 4 and 6 are included in the indirect application method. In FIGS. 2, 4 and 6, a lubricant is applied to the surface of the photoreceptor 101 via the charging roller 102*a,* the transfer belt 106*b* and the cleaning brush 113, respectively. The lubricant application method as shown in FIG. 7 is included in the direct application method.

The lubricant applicators will be explained in detail referring to drawings.

FIG. 2 illustrates an embodiment of the lubricant applicator for use in the present invention, and FIG. 3 is an enlarged view of a portion 3 of a charging roller 102*a*. As shown in FIGS. 2 and 3, the charging roller 102*a* has a surface layer including a complex material including a functional material 111 which is mainly used for charging the photoreceptor and a lubrication imparting material (i.e., a lubricant) 112. By contacting the charging roller 102*a* with the surface of the photoreceptor 101, the lubricant 112, which seeps through the functional material 111, is applied to the surface of the photoreceptor 101.

FIG. 4 illustrates another embodiment of the lubricant applicator and FIG. 5 is an enlarged view of a portion 5 of a transfer belt 106*b*. As shown in FIGS. 4 and 5, the transfer belt 106*b* similarly has a surface layer including a complex material including a functional material 119 which is mainly used for applying a transfer bias to a receiving material and a lubrication imparting material (i.e., a lubricant) 120. By contacting the transfer belt 106*b* with the surface of the photoreceptor 101 when a receiving material is not present between the photoreceptor 101 and the transfer belt 196*b,* the lubricant can be applied to the surface of the photoreceptor 101.

FIG. 6 is a schematic view illustrating yet another embodiment of the lubricant applicator. As shown in FIG. 6, a lubricant 115 and a lubricant applying roller 114 are provided in the cleaner. The lubricant 115 is pressed to the lubricant applying roller 114 by a spring 116. The lubricant 115 is applied to the lubricant applying roller 114 and then transferred on the cleaning brush 113. Then the lubricant 115 on the surface of the cleaning brush 113 is applied to the surface of the photoreceptor when the cleaning operation is performed. Numeral 107 denotes a cleaning blade.

The lubricant applicator illustrated in FIG. 7 is a direct applicator and is provided at a location just after the cleaning blade 107. As shown in FIG. 7, a lubricant applying member 117, which is pressed by a spring 118, contacts the photoreceptor to directly apply a lubricant to the surface of the photoreceptor 101.

In the image forming apparatus of the present invention, in order to maintain the friction coefficient of the surface of the photoreceptor so as to be in the above-mentioned preferable range while balancing application and removal of the lubricant, various cleaners can be used. With respect to removal of the lubricant present on the surface of the photoreceptor, it is effective to remove part of the lubricant, for example, to remove only the surface portion of the lubricant present on the surface of the photoreceptor. Part of the lubricant on the surface of the photoreceptor can be removed by using a cleaning brush in which hardness of bristles of the brush and/or density of the bristles are appropriately controlled. By using such a brush, ionic products formed on the surface of the photoreceptor can be segmentized, resulting in isolation of low resistant portions, and thereby deterioration of image qualities can be prevented.

In the image forming apparatus, it is important to remove the lubricant on the surface of the photoreceptor rather than to apply the lubricant to the surface of the photoreceptor. In order to effectively remove the lubricant on the surface of the photoreceptor, an additional brush or blade may be provided. In addition, the cleaning brush as shown in FIG. 6 may be rotated in the same direction as that of the photoreceptor to increase the speed of the brush relative to the photoreceptor. In this case, the rotating conditions of the cleaning brush should be charged to the extent that the toner removing effect is not deteriorated.

In addition, it is preferable to use a brush having looped bristles and/or hard bristles to improve the scrapability of the brush. Further, it is also preferable that when the lubricant on the surface of the photoreceptor is removed, the cleaning blade is contacted to the surface of the photoreceptor at a pressure higher than that in the usual cleaning operation. Furthermore, it is preferable to use a cleaning blade whose tip edge includes a filler to improve the scrapability of the cleaning blade. These scrapability improving methods are only useful for the photoreceptor for use in the present invention which has a protective layer including a filler.

Specific examples of the lubricant for use in the image forming apparatus of the present invention include lubricative oils such as silicone oils and fluorine-containing oils; and lubricative solids (e.g., fluorine-containing resins such as polytetrafluoroethylene (PTFE), perfluoroalkoxyethylene copolymers (PFA) and polyvinylidene fluoride (PVDF)), silicone resins, polyolefin resins, silicone greases, fluorine-containing greases, paraffin waxes, fatty acid esters, fatty acid metal salts such as zinc stearate, graphite, molybdenum disulfide, etc. These lubricants are applied using a lubricant applicator.

Specific examples of the lubricants for use in the toner include fatty acid metal salts such as zinc stearate, zinc laurate, zinc myristate, calcium stearate, aluminum stearate, etc. These lubricants can be added in the toner in an amount of from 0.1 to 0.2% by weight based on the total weight of the toner. In addition, a wax such as waxes mentioned above can also be included in the toner to be transferred onto the surface of the photoreceptor. In this case, it is important to control the content of the wax present on the surface of the toner particles. Therefore it is preferable to include a wax dispersant in the toner together with the toner constituents such as binder resins, colorants and charge controlling agents. The content of a wax in the toner is preferably from 3 to 6% by weight based on the total weight of the toner.

Next, the photoreceptor for use in the image forming apparatus of the present invention will be explained.

Figure 8:
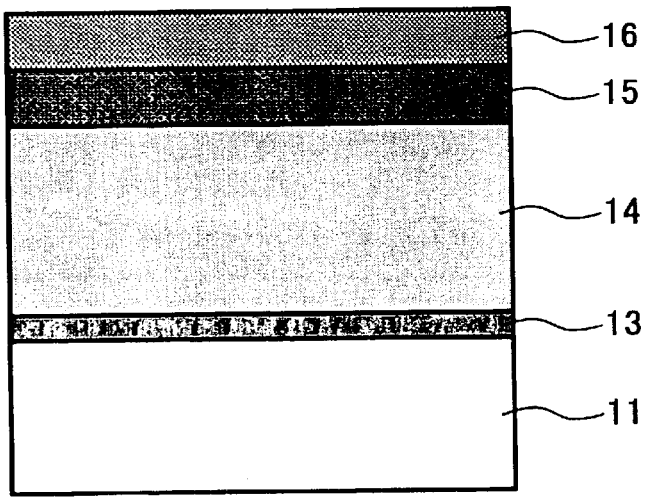
FIG. 8 is a schematic view illustrating the cross section of an embodiment of the photoreceptor for use in the image forming apparatus of the present invention.

FIG. 8 is a schematic view illustrating the cross section of an embodiment of the photoreceptor.

The photoreceptor includes an electroconductive substrate 21, an undercoat layer 25 located on the substrate 21, a photosensitive layer 23 located on the undercoat layer 25 and a protective layer 34 located on the photosensitive layer 23. The photosensitive layer includes a charge generation layer 31 and a charge transport layer 33 located on the charge generation layer 31.

Suitable materials for use as the electroconductive substrate 21 include plastic films, plastic cylinders or papers coated with a material having a volume resistance not greater than $10^{10}$ Ω·cm, for example, metals such as aluminium, nickel, chromium, nichrome, copper, silver, gold and platinum, and metal oxides such as tin oxides and indium oxides by a deposition or sputtering method. In addition, plates of a metal such as aluminium, aluminium alloys, nickel and stainless steel can be used. Tubes prepared by tubing such metal plates can also be used, the surface of which is treated by cutting, super finishing and polishing.

The charge generation layer 31 includes a charge generation material as a main component and optionally a binder resin. As the charge generation material, inorganic charge generation materials and organic charge generation materials can be used.

Specific examples of the inorganic charge generation materials include crystalline selenium, amorphous selenium, selenium-tellurium alloys, selenium-tellurium-halogen alloys, selenium-arsenic alloys, amorphous silicon, etc. Suitable amorphous silicon includes ones in which a dangling bond is terminated with a hydrogen atom or a halogen atom or in which a boron atom or a phosphorus atom is doped.

Specific examples of the organic charge generation materials include phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bis-stilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole and the like materials. These charge generation materials can be used alone or in combination.

Specific examples of the binder resin, which is optionally used in the charge generation layer 31, include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like. These binder resins can be used alone or in combination.

In addition, one or more charge transport materials may be included in the charge generation layer 31.

Suitable low molecular weight charge transport materials for use in the charge generation layer include electron transport materials and positive-hole transport materials. Specific examples of the electron transport materials include electron-accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetranitroxanthone, 2,4,8-trinitrothioxanthone, 2,6,8-trinitro-4H-indeno [1,2-b]thiophene-4-one and 1,3,7-trinitrodibenzothiophene-5,5-dioxides.

These electron transport materials can be used alone in combination.

Specific examples of the positive-hole transport materials include electron donating materials such as oxazole derivatives, oxadiazole derivatives, imidazole derivatives, triphenylamine derivatives, 9-(p-diethylaminostyrylanthracene), 1,1-bis-(4-dibenzilaminophenyl)propane, styrylanthracene, styrylpyrazoline, phenylhydrazone, α-phenylstilbene derivatives, thiazole derivatives, triazole derivatives, phenazine derivatives, acridine derivatives, benzofuran derivatives, benzimidazole derivatives and thiophene derivatives.

These positive-hole transport materials can be used alone in combination.

Suitable methods for forming the charge generation layer 31 include thin film forming methods in a vacuum, and casting methods.

Specific examples of such thin film forming methods in a vacuum include vacuum evaporation methods, glow discharge decomposition methods, ion plating methods, sputtering methods, reaction sputtering methods, CVD (chemical vapor deposition) methods, and the like methods. A layer of the above-mentioned inorganic and organic materials can be formed by one of these methods.

The casting methods useful for forming the charge generation layer 31 include, for example, the following steps:

(1) preparing a coating liquid by mixing one or more inorganic or organic charge generation materials mentioned above with a solvent such as tetrahydrofuran, cyclohexanone, dioxane, dichloroethane, butanone and the like, and optionally together with a binder resin and an additives, and then dispersing the materials with a ball mill, an attritor, a sand mill or the like;

(2) coating on a substrate the coating liquid, which is diluted if necessary, by a dip coating method, a spray coating method, a bead coating method, a ring coating method or the like method; and (3) drying the coated liquid to form a charge generation layer.

The thickness of the charge generation layer 31 is preferably from about 0.01 to about 5 μm, and more preferably from about 0.05 to about 2 μm.

Next, the charge transport layer 33 will be explained in detail.

The charge transport layer 33 transports the carriers, which are selectively generated in the charge generation layer 31 by irradiating the photosensitive layer with image-wise light, to form an electrostatic latent image on the surface of the photoreceptor. The charge transport layer may be a layer which includes one or more of the low molecular weight charge transport materials mentioned above for use in the charge generation layer 31 together with a binder resin; or a layer mainly including one or more high molecular weight charge transport materials (i.e., charge transport polymer materials). The charge transport layer 33 is typically prepared by coating a coating liquid in which the above-mentioned materials are dissolved or dispersed in a solvent, and then drying the coated liquid.

Specific examples of the binder resins which are used in combination with the low molecular weight charge transport materials include polycarbonate resins such as bisphenol A-form and bisphenol Z-form polycarbonate resins, polyester resins, methacrylic resins, acrylic resins, polyethylene resins, vinyl chloride resins, vinyl acetate resins, polystyrene resins, phenolic resins, epoxy resins, polyurethane resins, polyvinylidene chloride resins, alkyd resins, silicone resins, polyvinyl carbazole resins, polyvinyl butyral resins, polyvinyl formal resins, polyacrylate resins, polyacrylamide resins, phenoxy resins, and the like resins. These binder resins can be used alone or in combination.

As the high molecular weight charge transport material, the following known charge transport polymer materials (i.e., polymers having an electron donating group) can be used:

(a) polymers having a carbazole ring in their main chain and/or side chain

Specific examples of such materials include poly-N-vinyl carbazole, and compounds disclosed in Japanese Laid-Open Patent Publications Nos. 50-82056, 54-9632, 54-11737, and 4-183719.

(b) polymers having a hydrazone skeleton in their main chain and/or side chain

Specific examples of such materials include compounds disclosed in Japanese Laid-Open Patent Publications Nos. 57-78402 and 3-50555.

(c) Polysilylene compounds

Specific examples of such materials include polysilylene compounds disclosed in Japanese Laid-Open Patent Publications Nos. 63-285552, 5-19497 and 5-70595.

(d) Polymers having a tertiary amine skeleton in their main chain and/or side chain Specific examples of such materials include N,N-bis(4-methylphenyl)-4-aminopolystyrene, and compounds disclosed in Japanese Laid-Open Patent Publications Nos. 1-13061, 1-19049, 1-1728, 1-105260, 2-167335, 5-66598 and 5-40350.

(e) Other polymers

Specific examples of such materials include condensation products of nitropyrene with formaldehyde, and compounds disclosed in Japanese Laid-Open Patent Publications Nos. 51-73888 and 56-150749.

The high molecular weight charge transport polymer material (polymer having an electron donating group) for use in the charge transport layer 33 is not limited thereto, and known copolymers (random, block and graft copolymers) and star polymers, which have an electron donating group, and crosslinking polymers having an electron donating group disclosed in, for example, Japanese Laid-Open Patent Publication No. 3-109406 can also be used.

The high molecular weight charge transport material is optionally used together with a binder resin, a low molecular weight charge transport material and/or additives such as plasticizers and leveling agents.

Specific examples of the plasticizers include known plasticizers, which have been used for plasticizing a resin, such as dibutyl phthalate, and dioctyl phthalate. The content of the plasticizer in the charge transport layer is preferably from 0 to 30 parts by weight per 100 parts by weight of the binder resin (and/or charge transport polymer material) included in the layer.

Specific examples of the leveling agents include silicone oils such as dimethyl silicone oils and methylphenyl silicone oils; and polymers and oligomers having a perfluoroalkyl group in their side chain. The content of the leveling agent in the charge transport layer is preferably from 0 to 1 part by weight per 100 parts by weight of the binder resin (and/or charge transport polymer material) included in the layer.

The thickness of the charge transport layer 33 is preferably from 8 $\mu$m to 22 $\mu$m.

When electrostatic latent images are formed using a light beam having a diameter not greater than 50 $\mu$m, the photosensitive layer has to be thinned to produce high resolution images. When the photosensitive layer is thick, the image-wise light tends to scatter in the photosensitive layer, resulting in deterioration of image resolution. Therefore, even when a light beam having a small diameter is used for forming latent images, high resolution images cannot be formed if the photosensitive layer is thick.

As a result of the present inventors' investigation, the thickness of the photosensitive layer is preferably from 8 $\mu$m to 22 $\mu$m in view of the resolution of the resultant images and the charging ability of the photoreceptor. This thickness is relatively thin compared to that of the photosensitive layer of conventional photoreceptors. However, since the photoreceptor of the present invention has a protective layer including a filler and a lubricant is applied to the surface of the protective layer to control the friction surface, the photoreceptor can produce high resolution images for a long period of time (i.e., about more than 200,000 copies).

The photoreceptor of the present invention may include the undercoat layer 25 which is formed between the electroconductive substrate 21 and the photosensitive layer 23 (or the charge generation layer 31). The undercoat layer is formed, for example, to improve adhesion of the photosensitive layer 23 to the substrate 21, to prevent moire in the resultant image, to improve the coating quality of the upper layer (i.e., to form a uniform layer of the photosensitive layer 23 or the charge generation layer 31), to decrease residual potential in the resultant photoreceptor, and/or to prevent charge injection from the substrate 21 to the photosensitive layer 23.

The undercoat layer 25 mainly includes a resin. Since a photosensitive layer coating liquid, which typically includes an organic solvent, is coated on the undercoat layer, the resin used in the undercoat layer preferably has good resistance to popular organic solvents.

Specific examples of such resins for use in the undercoat layer include water-soluble resins such as polyvinyl alcohol, casein and polyacrylic acid; alcohol-soluble resins such as nylon copolymers, and methoxymethylated nylons; and crosslinkable resins such as polyurethane resins, melamine resins, alkyd-melamine resins, and epoxy resins. In addition, the undercoat layer may include a fine powder such as metal oxides (e.g., titanium oxide, silica, alumina, zirconiumoxide, tin oxide, and indium oxide), metal sulfides, and metal nitrides. When the undercoat layer 25 is formed using these materials, known coating methods using a proper solvent can be used similarly to the photosensitive layer.

In addition, a metal oxide layer which is formed, for example, by a sol-gel method using a silane coupling agent, titanium coupling agent or a chromium coupling agent can also be used as the undercoat layer.

Further, a layer of aluminum oxide which is formed by an anodic oxidation method, and a layer of an organic compound such as polyparaxylylene or an inorganic compound such as SiO, $SnO_2$, $TiO_2$, ITO or $CeO_2$, which is formed by a vacuum evaporation method, are also preferably used as the undercoat layer.

In the photoreceptor of the present invention, one or more antioxidants can be used in one or more of the layers including an organic material, to improve the dependency of the photoreceptor on environmental conditions, i.e., to prevent deterioration of photosensitivity and increase of residual potential. In particular, good results can be obtained when an antioxidant is included in the layer including a charge transport material.

Suitable antioxidants for use in the photoreceptor include the following compounds, but are not limited thereto.

Monophenol Compounds 2,6-di-t-butyl-p-cresol, butylated hydroxyanisole, 2,6-di-t-butyl-4-ethylphenol, stearyl-β-(3,5-di-t-butyl-4-hydroxyphenyl)propionate, and the like compounds;

Bisphenol Compounds 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), and the like compounds;

High Molecular Phenolic Compounds 1,1,3-tris-(2-methyl-4-hydroxy-5-t-butylphenyl)butane, 1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane, bis[3,3'-bis(4'-hydroxy-3'-t-butylphenyl)butyric acid]glycol ester, tocophenol compounds, and the like compounds.

Paraphenylenediamine Compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like compounds.

Hydroquinone Compounds 2,5-di-t-octylhydroquinone, 2, 6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone, and the like compounds.

Sulfur-Containing Organic Compounds dilauryl-3,3'-thiodipropionate, distearyl-3,3'-thiodipropionate, ditetradecyl-3,3'-thiodipropionate, and the like compounds.

Phosphorus-Containing Organic Compounds triphenylphosphine, tri(nonylphenyl)phosphine, tri (dinonylphenyl)phosphine, tricresylphosphine, tri(2,4-dibutylphenoxy)phosphine, and the like compounds.

These compounds are commercially available because of being used as antioxidants for use in rubbers, plastics, and oils and fats.

The content of the antioxidant in the photosensitive layer (or protective layer) is from 0.1 to 100 parts by weight, and preferably from 2 to 30 parts by weight, per 100 parts by weight of the charge transport material included in the layer.

The photoreceptor of the present invention may include the protective layer 34 on the photosensitive layer (i.e., the photosensitive layer 23 or charge transport layer 33) to protect the photosensitive layer and to improve the durability of the photoreceptor. Specific examples of the materials for use in the protective layer 34 include ABS resins, ACS resins, olefin-vinyl monomer copolymers, chlorinated polyethers, aryl resins, phenolic resins, polyacetal resins, polyamide resins, polyamideimide resins, polyacrylate resins, polyarylsulfone resins, polybutylene resins, polybutyleneterephthalate resins, polycarbonate resins, polyethersulfone resins, polyethylene resins, polyethyleneterephthalate resins, polyimide resins, acrylic resins, polymethylpentene resins, polypropylene resins, polyphenylene oxide resins, polysulfone resins, polystyrene resins, AS resins, butadiene-styrene copolymers, polyurethane resins, polyvinyl chloride resins, polyvinylidene chloride resins, epoxy resins and the like resins.

The protective layer 34 includes a filler to improve the abrasion resistance of the photoreceptor. Specific examples of such a filler include particulate fluorine-containing resins such as polytetrafluoroethylene and silicone resins. In addition, inorganic materials such as titanium oxides, silica, alumina, zirconium oxide, tin oxides, potassium titanate, etc. can also be used as the filler.

The content of the filler in the protective layer 34 is preferably from 5 to 40% by weight and more preferably from 20 to 30% by weight. When the content is too low, abrasion resistance cannot be improved. When the content is too high, the surface potential of lighted areas (i.e., the residual potential) of the photoreceptor increases after the photoreceptor is exposed to imagewise light, resulting in occurrence of problems such as background developing of images due to the deterioration of photosensitivity of the photoreceptor.

In order to improve the dispersion property of the filler, dispersants can be used. Suitable dispersants include known dispersants for use in paints, etc. The content of the dispersant in the protective layer 34 is from 0.5 to 4% by weight, and preferably from 1 to 2% by weight, based on the weight of the filler included in the protective layer.

In addition, it is preferable to add one or more of the charge transport materials mentioned above to the protective layer 34. Further, the protective layer 34 may include one or more of the antioxidants mentioned below.

The protective layer 34 is typically formed by a known coating method such as spray coating methods. The thickness of the protective layer 34 is preferably from 0.5 to 10 μm and more preferably from 4 to 6 μm.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Preparation of Photoreceptor No. 1

Each of the undercoat layer coating liquid, charge generation layer coating liquid, charge transport layer coating liquid and protective layer coating liquid, which have the following formulations, was coated on an aluminum drum having a diameter of 30 mm and then dried to prepare an electrophotographic photoreceptor No. 1 having an under coat layer of 3.5 μm thick, a charge generation layer of 0.2 μm thick, a charge transport layer of 18 μm thick and a protective layer of 5 μm thick one by one.

The protective layer was formed by a spray coating method, and the other layers were formed by a dip coating method.

| Undercoat layer coating liquid | |
|---|---|
| Alkyd resin (BEKKOZOL 1307-60-EL from Dainippon Ink & Chemicals, Inc.) | 6 |
| Melamine resin (SUPERBEKKAMIN G-821-60 from Dainippon Ink & Chemicals, Inc.) | 4 |
| Titanium oxide | 40 |
| Methyl ethyl ketone | 200 |

Charge Generation Layer Coating Liquid

| Charge Generation Layer Coating Liquid | |
|---|---|
| (1) 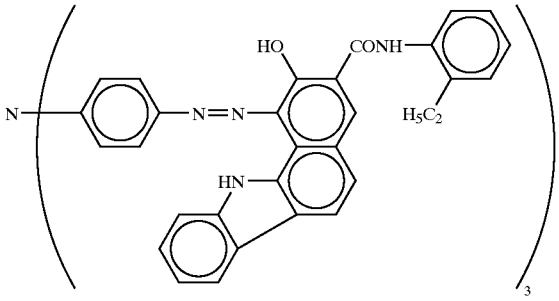 | |
| Polyvinyl butyral (XYHL from Union Carbide Corporation) | 0.25 |
| Cyclohexanone | 200 |
| Methyl ethyl ketone | 80 |
| Charge transport layer coating liquid | |
| Bisphenol A-form Polycarbonate (PANLITE K1300 from Teijin Limited) | 10 |
| Low molecular-weight charge transport material having the following formula (2) | 10 |
| (2) 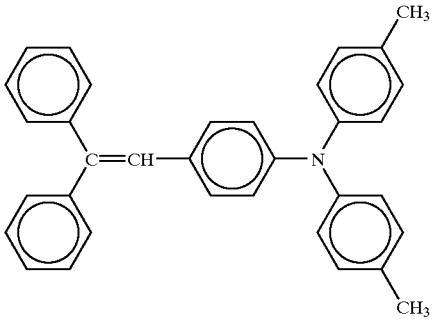 | |
| Methylene chloride | 100 |
| Protective layer coating liquid | |
| Polycarbonate | 10 |
| Charge transport material having formula (2) | 7 |
| Fine particles of alumina (AA-03 from Sumitomo Chemical Co., Ltd., having a central particle diameter of 0.3 μm) | 6 |
| Dispersant (BYK-P104 from BYK Chemie Japan) | 0.08 |
| Tetrahydrofuran | 700 |
| Cyclohexanone | 200 |

Preparation of Photoreceptor No. 2

The procedure for preparation of the photoreceptor No. 1 was repeated except that the charge generation layer coating liquid was replaced with the following charge generation layer coating liquid which was prepared by mixing the following components by a ball mill.

| Charge generation layer coating liquid | |
|---|---|
| Y-form oxotitanylphthalocyanine pigment | 2 |
| Polyvinyl butyral (S-LEC BM-S from Sekisui Chemical Co., Ltd.) | 0.2 |
| Tetrahydrofuran | 50 |

Thus an electrophotographic photoreceptor No. 2 was prepared.

One of the thus prepared photoreceptors Nos. 1 and 2 was set in each of the image forming apparatus described in Examples 1 to 8 and Comparative Examples 1 to 6 to perform a running test.

The running test was performed by the following method.

Method of Running Test

A running test of at most 200,000 copies was performed using a digital copier, IMAGIO MF200 manufactured by Ricoh Co., Ltd., which had a construction as shown in FIG. 1 and which had been modified so as to have a lubricant applicator, and a cleaning brush located upstream from the cleaning blade, was used as the image forming apparatus. The setting conditions of the lubricant applicator and cleaning brush were changed as described below.

Both ends of the charging roller were wound with a polyester film having a thickness of 50 μm and a width of 10 mm to form a gap of about 50 μm between the surface of the charging roller and the photoreceptor. In addition, a DC voltage (−650V) overlapped with an AC voltage having a peak-to peak voltage of 1.8 kV and a frequency of 2 kHz was applied to the charging roller. Further, the initial potentials of the photoreceptor were set such that the potential (VD) at a dark area was −600 V and the potential (VL) at a lighted area was −120 V.

In and after the running test, image qualities (image tailing at 30° C. 90%RH, filming and cleaning property), friction coefficient of the surface of the photoreceptor, and surface conditions of the surface of the photoreceptor were evaluated.

Method for Evaluating Image Qualities

The produced images were visually observed and the images were graded as follows:

○: No image tailing was observed. (good)

Δ: Slight image tailing was observed.

X: Image tailing was observed.

◇: Ridge-form filming was observed.

□: Cleaning was defective.

Static Friction Coefficient (μs) of Surface of Photoreceptor

Static friction coefficient was measured based on the Euler belt method mentioned above.

Surface Conditions of Photoreceptor

The maximum height of the profile of the surface of the photoreceptor in the direction perpendicular to the rotating direction of the photoreceptor in a range of 50 μm was measured using a surface analyzer VK-8550 COLOR LASER 3D PROFILE MICROSCOPE manufactured by KEYENCE CORPORATION.

Example 1

A running test was performed using the photoreceptor No.1. The cleaner had a cleaning brush and a cleaning blade. The lubricant applicator had the construction as shown in FIG. 6 and polytetrafluoroethylene (PTFE) was used as the lubricant.

The conditions of the cleaner were as follows:

(1) cleaning brush

A cleaning brush having straight polyester bristles was used.

(2) Rotating speed and direction of cleaning brush

Rotating speed: 1.8 times the rotating speed of the photoreceptor

Rotating direction: same as that of the photoreceptor (namely, at the contact point of the cleaning brush with the photoreceptor, the moving direction of the cleaning brush is opposite to that of the photoreceptor)

(3) Lubricant application method

The lubricant was applied to the surface of the photoreceptor via the cleaning brush.

The evaluation results are shown in Table 1.

Example 2

The procedures for the running test and the evaluation in Example 1 were repeated except that the photoreceptor No. 1 was replaced with the photoreceptor No.2.

Example 3

The procedures for the running test and the evaluation in Example 2 were repeated except that the lubricant was changed to zinc stearate which had been melted and then solidified; and the rotating direction of the cleaning brush was changed so as to be opposite to the rotating direction of the photoreceptor.

Comparative Example 1

The procedures for the running test and the evaluation in Example 3 were repeated except that the rotating speed of the cleaning brush was changed to 1.0 time that of the photoreceptor.

Comparative Example 2

A running test was performed using the photoreceptor No. 1. The cleaning brush was not used (only a cleaning blade was used). The lubricant applicator had the construction as shown in FIG. 7 (i.e., a direct lubricant applicator) and polytetrafluoroethylene (PTFE) was used as the lubricant.

Example 4

The procedures for the running test and the evaluation in Comparative Example 2 were repeated except that a cleaning brush having straight polyester bristles was provided in the cleaner.

Example 5

The procedures for the running test and the evaluation in Example 1 were repeated except that the lubricant was replaced with a PTFE which included titanium oxide in an amount of 10% by weight.

Example 6

The procedures for the running test and the evaluation in Example 1 were repeated except that the lubricant was replaced with a PTFE which included a perfluoroalkoxyethylene copolymer (PFA) in an amount of 10% by weight.

Example 7

The procedures for the running test and the evaluation in Example 2 were repeated except that the lubricant (PTFE) was not applied and the toner was replaced with a toner including a zinc stearate powder in an amount of 0.15% by weight based on the total weight of the toner.

Example 8

The procedures for the running test and the evaluation in Example 2 were repeated except that the lubricant (PTFE) was not applied and the toner was replaced with a toner prepared by a pulverization method and including a carnauba wax in an amount of 5% by weight and a polyethylene-styrene-acrylic copolymer in an amount of 5% by weight, based on the total weight of the toner.

Comparative Example 3

A running test was performed using the photoreceptor No. 2 and unmodified IMAGIO MF200 manufactured by Ricoh Co., Ltd. i.e., a cleaning brush and a lubricant applicator were not provided).

Comparative Example 4

The procedures for the running test and the evaluation in Example 1 were repeated except that the lubricant was not applied.

Comparative Example 5

The procedures for the running test and the evaluation in Example 7 were repeated except that the rotating direction of the cleaning brush was changed so as to be opposite to that of the photoreceptor and the rotating speed of the cleaning brush was changed to 1.0 time that of the photoreceptor.

Comparative Example 6

The procedures for the running test and the evaluation in Example 8 were repeated except that the rotating direction of the cleaning brush was changed so as to be opposite to that of the photoreceptor and the rotating speed of the cleaning brush was changed to 1.0 time that of the photoreceptor.

TABLE 1

| | | After 100,000 copies | | | After 200,000 copies | | |
|---|---|---|---|---|---|---|---|
| | Photo-receptor No. | Max. height (μm) | μs | Image qualities | Max. height (μm) | μs | Image qualities |
| Ex. 1 | 1 | 1.6 | 0.30 | ○ | 1.9 | 0.32 | ○ |
| Ex. 2 | 2 | 1.5 | 0.31 | ○ | 1.6 | 0.32 | ○ |
| Ex. 3 | 2 | 2.5 | 0.33 | ○ | 2.3 | 0.35 | ○ |
| Ex. 4 | 1 | 2.8 | 0.40 | ○ | 2.9 | 0.38 | ○ |
| Ex. 5 | 1 | 1.1 | 0.37 | ○ | 1.2 | 0.41 | ○ |
| Ex. 6 | 1 | 1.3 | 0.39 | ○ | 1.2 | 0.39 | ○ |
| Ex. 7 | 2 | 2.5 | 0.41 | ○ | 2.6 | 0.43 | ○ |
| Ex. 8 | 2 | 2.8 | 0.49 | ○ | 2.8 | 0.45 | ○ |
| Comp. Ex. 1 | 2 | 3.5 | 0.11 | X | 3.3 | 0.10 | X |
| Comp. Ex. 2 | 1 | 3.8 | 0.23 | Δ | 3.5 | 0.21 | Δ◇ |
| Comp. Ex. 3 | 2 | 4.9 | 0.55 | □ | 4.7 | 0.61 | □ |
| Comp. Ex. 4 | 1 | 4.3 | 0.59 | ◇ | 4.5 | 0.60 | Δ◇ |
| Comp. Ex. 5 | 2 | 3.5 | 0.22 | Δ | 4.3 | 0.20 | ◇X |
| Comp. Ex. 6 | 2 | 3.3 | 0.29 | Δ | 3.4 | 0.23 | ◇X |

As can be understood from Table 1, the image forming apparatus of the present invention can stably produce good images without image defects such as tailing for a long period of time. This is because the surface conditions of the photoreceptor are controlled such that the maximum height is not greater than 3 μm.

In contrast, comparative image forming apparatus produce poor images having image defects such as tailing or the like and/or have a drawback in that the photoreceptor is largely abraded. This is because the surface conditions of the photoreceptor are not controlled such that the maximum height is not greater than 3 μm. Namely the comparative image forming apparatus have poor durability and reliability.

This document claims priority and contains subject matter related to Japanese Patent Applications Nos. 2001-074470 and 2002-52211, filed on Mar. 15, 2001 and Feb. 27, 2002, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image forming apparatus comprising:

a photoreceptor configured to bear an electrostatic latent image on a surface thereof while rotating in a direction;

a latent image former cooperatively associated with said photoreceptor to form the electrostatic latent image on the surface of the photoreceptor;

an image developer cooperatively associated with said photoreceptor to develop the electrostatic latent image with a developer, wherein the developer comprises a toner;

an image transfer device cooperatively associated with said photoreceptor to transfer the toner image onto a receiving material;

a cleaner cooperatively associated with said photoreceptor to remove the toner remaining on the surface of the photoreceptor while contacting the surface of the photoreceptor; and a surface condition controller configured to control a condition of the surface of the photoreceptor, wherein the photoreceptor comprises:

an electroconductive substrate, a photosensitive layer located overlying the substrate, a protective layer located overlying the photosensitive layer, wherein the protective layer comprises a filler, and the surface of the photoreceptor includes ridges and grooves.

2. The image forming apparatus according to claim 1, wherein the surface condition controller controls the condition of the surface of the photoreceptor such that the surface of the photoreceptor maintains a maximum height not greater than about 3 μm in a part of a profile of the surface of the photoreceptor, in a sampling range of about 50 μm in a direction perpendicular to the rotating direction of the photoreceptor.

3. The image forming apparatus according to claim 1, wherein the surface condition controller controls a friction coefficient of the surface of the photoreceptor by applying a lubricant to the surface of the photoreceptor.

4. The image forming apparatus according to claim 3, wherein the toner comprises the lubricant, and wherein the surface condition controller applies the lubricant to the surface of the photoreceptor with the toner.

5. The image forming apparatus according to claim 4, wherein the lubricant is a lubricant powder, and wherein the lubricant powder is selected from the group consisting of zinc stearate, zinc laurate, zinc myristate, calcium stearate and aluminum stearate.

6. The image forming apparatus according to claim 4, wherein the lubricant is a wax.

7. The image forming apparatus according to claim 1, wherein the surface condition controller is located downstream from the image transfer device and upstream from the image developer relative to the rotating direction of the photoreceptor.

8. The image forming apparatus according to claim 1, wherein the surface condition controller is the cleaner, and wherein the cleaner applies a lubricant to the surface of the photoreceptor.

9. The image forming apparatus according to claim 1, wherein the surface condition controller is the image transfer device, and wherein the image transfer device applies a lubricant to the surface of the photoreceptor.

10. The image forming apparatus according to claim 1, wherein the latent image former comprises a contact charger, wherein the surface condition controller is the latent image former, and wherein the contact charger applies a lubricant to the surface of the photoreceptor.

11. The image forming apparatus according to claim 1, wherein the surface condition controller controls the friction coefficient of the surface of the photoreceptor to be from about 0.3 to about 0.5.

12. The image forming apparatus according to claim 1, wherein the latent image former comprises a charger, which is one of contact chargers and proximity chargers.

13. The image forming apparatus according to claim 1, wherein the latent image former comprises a charger applying a DC voltage overlapped with an AC voltage to the photoreceptor.

14. A process cartridge comprising:

a photoreceptor configured to bear an electrostatic latent image while rotating in a direction; and at least one of a latent image former cooperatively associated with said photoreceptor to form the electrostatic latent image on a surface of the photoreceptor;

an image developer cooperatively associated with said photoreceptor to develop the electrostatic latent image with a developer, wherein the developer comprises a toner;

an image transfer device cooperatively associated with said photoreceptor to transfer the toner image onto a receiving material; and a cleaner cooperatively associated with said photoreceptor to remove the toner remaining on the surface of the photoreceptor while contacting the surface of the photoreceptor, wherein the surface of the photoreceptor has a maximum height not greater than about 3 μm in a part of a profile of the surface of the photoreceptor, in a sampling range of about 50 μm in a direction perpendicular to the rotating direction of the photoreceptor, and wherein the photoreceptor comprises, an electroconductive substrate, a photosensitive layer located overlying the substrate, and a protective layer located overlying the photosensitive layer, wherein the protective layer comprises a filler.

15. The process cartridge according to claim 14, wherein the surface of the photoreceptor has a friction coefficient of from about 0.3 to about 0.5.

16. A process cartridge comprising:

a photoreceptor configured to bear an electrostatic latent image while rotating in a direction; and at least one of a latent image former cooperatively associated with said photoreceptor to form the electrostatic latent image on a surface of the photoreceptor;

an image developer cooperatively associated with said photoreceptor to develop the electrostatic latent image with a developer;

wherein the developer comprises a toner;

an image transfer device cooperatively associated with said photoreceptor to transfer the toner image onto a receiving material; and a cleaner cooperatively associated with said photoreceptor to remove the toner remaining on the surface of the photoreceptor while contacting the surface of the photoreceptor, wherein the surface of the photoreceptor has a friction coefficient of from about 0.3 to about 0.5, wherein the photoreceptor comprises, an electroconductive substrate, a photosensitive layer located overlying the substrate, and a protective layer located overlying the photosensitive layer, wherein the protective layer comprises a filler, and wherein the surface of the photoreceptor includes ridges and grooves.

17. An image forming method comprising the steps of:

forming an electrostatic latent image on a surface of a photoreceptor while rotating the photoreceptor in a direction;

developing the latent image with a developer comprising a toner;

transferring the toner image onto a receiving material; and controlling a roughness of the surface of the photoreceptor such that the maximum height of the surface of the photoreceptor is not greater than about 3 $\mu$m in a part of a profile of the surface of the photoreceptor, in a sampling range of about 50 $\mu$m in a direction perpendicular to the rotating direction of the photoreceptor.

18. The image forming method according to claim 17, further comprising:

controlling a friction coefficient of the surface of the photoreceptor to be from about 0.3 to about 0.5.

19. An image forming method comprising:

forming an electrostatic latent image on a surface of a photoreceptor;

developing the latent image with a developer comprising a toner;

transferring the toner image onto a receiving material;

controlling a friction coefficient of the surface of the photoreceptor to be from about 0.3 to about 0.5, and forming ridges and grooves on the surface of the photoreceptor.

20. An image forming apparatus, comprising:

means for forming an electrostatic latent image on a surface of a photoreceptor;

means for developing the latent image with a developer comprising a toner to form a toner image on the surface of the photoreceptor;

means for transferring the toner image onto a receiving material; and means for controlling a roughness of the surface of the photoreceptor such that the maximum height of the surface of the photoreceptor is not greater than about 3 $\mu$m in a part of a profile of the surface of the photoreceptor, in a range of about 50 $\mu$m in a direction perpendicular to the rotating direction of the photoreceptor.

21. The image forming apparatus according to claim 20, further comprising:

means for controlling a friction coefficient of the surface of the photoreceptor to be from about 0.3 to about 0.5.

22. An image forming apparatus comprising:

means for forming an electrostatic latent image on a surface of a photoreceptor;

means for developing the latent image with a developer comprising a toner to form a toner image on the surface of the photoreceptor;

means for transferring the toner image onto a receiving material;

means for controlling a friction coefficient of the surface of the photoreceptor to be from about 0.3 to 0.5; and means for forming ridges and grooves on the surface of the photoreceptor.

23. An image forming apparatus comprising:

a photoreceptor configured to bear an electrostatic latent image on a surface thereof while rotating in a direction;

a latent image former cooperatively associated with said photoreceptor to form the electrostatic latent image on the surface of the photoreceptor;

an image developer cooperatively associated with said photoreceptor to develop the electrostatic latent image with a developer, wherein the developer comprises a toner;

an image transfer device cooperatively associated with said photoreceptor to transfer the toner image onto a receiving material;

a cleaner cooperatively associated with said photoreceptor to remove the toner remaining on the surface of the photoreceptor while contacting the surface of the photoreceptor; and a surface condition controller configured to control a condition of the surface of the photoreceptor, wherein the photoreceptor comprises:

an electroconductive substrate, a photosensitive layer located overlying the substrate, a protective layer located overlying the photosensitive layer, wherein the protective layer comprises a filler, the surface of the photoreceptor includes ridges and grooves, and wherein the surface condition controller controls the condition of the surface of the photoreceptor such that the surface of the photoreceptor maintains a maximum height not greater than about 3 $\mu$m in a part of a profile of the surface of the photoreceptor, in a sampling range of about 50 $\mu$m in a direction perpendicular to the rotating direction of the photoreceptor.

* * * * *

UNITED STATES PATENT AND TRADEMARK OFFICE

CERTIFICATE OF CORRECTION

PATENT NO. : 6,686,114 B2
DATED : February 3, 2004
INVENTOR(S) : Yohta Sakon et al.

It is certified that error appears in the above-identified patent and that said Letters Patent is hereby corrected as shown below:

Drawings,
Replace Sheets 1 through 8 of the figures with the attached 6 replacement figure sheets.

Signed and Sealed this

Tenth Day of August, 2004

JON W. DUDAS
*Acting Director of the United States Patent and Trademark Office*